US009755325B2

(12) United States Patent
Tonoike et al.

(10) Patent No.: US 9,755,325 B2
(45) Date of Patent: Sep. 5, 2017

(54) TERMINAL, WIRE HARNESS, TERMINAL AND COATED CONDUCTOR WIRE CONNECTION METHOD, AND WIRE HARNESS STRUCTURE

(71) Applicants: Furukawa Electric Co., Ltd, Tokyo (JP); Furukawa Automotive Systems Inc., Inukami-gun (JP)

(72) Inventors: Takashi Tonoike, Inukami-gun (JP); Yukihiro Kawamura, Inukami-gun (JP); Yasushi Kihara, Tokyo (JP); Hiroshi Orito, Tokyo (JP); Kyutaro Abe, Tokyo (JP); Tsuneo Aoi, Tokyo (JP); Koji Yamanaka, Tokyo (JP); Tomoki Kawamura, Tokyo (JP)

(73) Assignees: FURUKAWA ELECTRIC CO., LTD., Tokyo (JP); FURUKAWA AUTOMOTIVE SYSTEMS INC., Inukami-gun (JP)

( * ) Notice: Subject to any disclaimer, the term of this patent is extended or adjusted under 35 U.S.C. 154(b) by 0 days.

(21) Appl. No.: 15/088,461

(22) Filed: Apr. 1, 2016

(65) Prior Publication Data

US 2016/0218443 A1 Jul. 28, 2016

Related U.S. Application Data

(63) Continuation of application No. PCT/JP2014/077386, filed on Oct. 15, 2014.

(30) Foreign Application Priority Data

Oct. 15, 2013 (JP) ..... 2013-214719
Jan. 14, 2014 (JP) ..... 2014-004326

(51) Int. Cl.
*H01R 43/048* (2006.01)
*H01R 4/18* (2006.01)
(Continued)

(52) U.S. Cl.
CPC ..... *H01R 4/183* (2013.01); *H01R 4/188* (2013.01); *H01R 4/62* (2013.01); *H01R 13/187* (2013.01); *H01R 43/048* (2013.01)

(58) Field of Classification Search
CPC ..... H01R 4/188; H01R 4/203; H01R 4/206; H01R 4/185; H01R 4/183; H01R 43/048; H01R 43/058
(Continued)

(56) References Cited

U.S. PATENT DOCUMENTS 2,685,076 A 7/1954 Hoffman
3,892,459 A 7/1975 Dittmann et al.
(Continued)

FOREIGN PATENT DOCUMENTS

JP 2002-124309 4/2002
JP 2009-112186 5/2009
(Continued)

OTHER PUBLICATIONS

International Search Report issued Nov. 11, 2014 in PCT/JP2014/077386, filed Oct. 15, 2014 (with English Translation).
(Continued)

*Primary Examiner* — Gary Paumen
(74) *Attorney, Agent, or Firm* — Oblon, McClelland, Maier & Neustadt, L.L.P.

(57) ABSTRACT

A conductor wire crimping portion (7) has depressions (13*a*, 13*b*, 13*c*) that are disposed at prescribed intervals in the axial direction and that are linear locking portions. The depressions (13*a*, 13*b*, 13*c*) are continuously depressed grooves on the inner surface of a crimping portion (5). On an upper die (30*a*), at a portion corresponding to the conductor wire crimping portion (7), a straight portion is formed, and in the front-back direction thereof, tapered portions are formed. More specifically, the upper die (30*a*)
(Continued)

is formed to have an inverted trapezoid shape, a middle portion of which protrudes in the crimping direction. Consequently, at each boundary between the straight portion and the tapered portion, a die angled portion (32) is formed. At an area corresponding to the straight portion of the upper die (30*a*), the depression (13*a*) is provided, and at an area corresponding to the die angled section (32), the depression (13*b*) is provided.

5 Claims, 23 Drawing Sheets

(51) Int. Cl.
*H01R 4/62* (2006.01)
*H01R 13/187* (2006.01)

(58) Field of Classification Search
USPC ..... 439/877–882; 29/863–867
See application file for complete search history.

(56) References Cited

U.S. PATENT DOCUMENTS 3,990,143 A 11/1976 Dittmann et al.
6,056,605 A * 5/2000 Nguyen ..... H01R 4/188 439/877
9,033,751 B2 * 5/2015 Sato ..... H01R 4/188 439/877
2009/0191771 A1 7/2009 Watanabe
2013/0130570 A1 * 5/2013 Onuma ..... H01R 4/188 439/882
2013/0143454 A1 * 6/2013 Onuma ..... H01R 4/188 439/877
2014/0004759 A1 * 1/2014 Kondou ..... H01R 4/185 439/878
2014/0213123 A1 * 7/2014 Ito ..... H01R 4/188 439/877

FOREIGN PATENT DOCUMENTS

JP 2009-176571 8/2009
JP 2010-27464 2/2010
JP 2012-9178 1/2012
JP 2013-62205 4/2013
WO WO 2014/129084 A1 8/2014

OTHER PUBLICATIONS

Supplementary European Search Report issued Mar. 27, 2017 in Application No. EP 14 85 3429.0 (11 pages).

* cited by examiner

TERMINAL, WIRE HARNESS, TERMINAL AND COATED CONDUCTOR WIRE CONNECTION METHOD, AND WIRE HARNESS STRUCTURE

TECHNICAL FIELD

The present invention relates to a wire harness, a terminal used for the wire harness, a terminal and covered conductor wire connection method, and a wire harness structure.

BACKGROUND ART

A terminal composed of a crimping portion and a terminal main body has been used as a terminal connected to a covered conductor wire. On a crimping surface of the crimping portion of such a terminal, locking portions called serrations (depressions) are formed in a plurality of rows at prescribed intervals in order to lock a portion of the conductor wire. The serrations prevent the conductor wire from coming out of the crimping portion by biting into the conductor wire when crimped to the conductor wire exposed from a covering of the covered conductor wire (Patent Document 1, for example).

CITATION LIST

Patent Literature

Patent Document 1: Japanese Unexamined Patent Application Publication No. 2012-009178A

SUMMARY OF INVENTION

Technical Problem

In recent years, aluminum conductor wires have been used to reduce the weight of wire harnesses. When a conductor wire is made of aluminum, providing serrations to the crimping portion makes it possible to not only prevent the conductor wire from coming out of the crimping portion but also achieve the effect of destroying an oxide film on the aluminum.

Meanwhile, dies used to crimp such a crimping portion include a die having a straight portion formed in an area that is to firmly crimp a conductor wire portion, and tapered portions formed on both sides of the straight portion in the front-back direction of the straight portion. The tapered portions prevent the formation of portions on both sides of the crimping portion from the area that is to firmly crimp the conductor wire, the portions being subjected to a sudden shape change.

However, stress concentrates in each area crimped by an angled portion located at each boundary portion between the straight portion and the tapered portion of the crimping die, readily causing cracking. In particular, the terminal becomes thinner in areas in which serrations are provided, and thus such areas tend to be starting points of cracking.

In light of the above, an object of the present invention is to provide a terminal or the like that is capable of suppressing cracking of a crimping portion.

Solution to Problem

To achieve the above-described object, a first aspect of the invention is a terminal including a terminal main body and a cylindrical crimping portion, the terminal being connected to a covered conductor wire. The crimping portion includes a cover crimping portion that crimps a covering portion and a conductor wire crimping portion that crimps a conductor wire exposed from the covering portion, the crimping portion being sealed in all areas excluding an area through which the covered conductor wire is inserted. The conductor wire crimping portion includes a plurality of depressions on the inner surface thereof, the depressions being formed in a plurality of rows in the axial direction of the conductor wire crimping portion and including main depressions formed at a substantial center in the axial direction of the conductor wire crimping portion and sub-depressions formed on both sides of the main depressions. The main depressions are formed substantially across the entire periphery of the wire crimping portion, and the sub-depressions have a formation range shorter than that of the main depressions and are not formed on the upper side of the wire crimping portion.

Further, the depressions may be formed by a plurality of small depressions that are provided in the circumferential direction of the conductor wire crimping portion.

The small depressions may include first small depressions provided on substantially upper and lower portions corresponding to the crimping direction, second small depressions provided on both side portions substantially orthogonal to the crimping direction of the conductor wire crimping portion, and third small depressions provided between the first small depressions and the second small depressions, in the circumferential direction of the conductor wire crimping portion. The length in the circumferential direction of the first small depressions is less than the length in the circumferential direction of the third small depressions, and the length in the circumferential direction of the second small depressions is greater than the length in the circumferential direction of the third small depressions.

According to the first aspect of the invention, the main depressions are formed in an area in which the conductor wire is mainly crimped, and the sub-depressions are provided on both sides in the front-back direction thereof. At this time, because the sub-depressions have a short length in the circumferential direction, the sub-depressions are not formed in the areas that are crimped at each boundary portion between the straight portion and the tapered portions of the aforementioned die. As a result, thin areas do not exist in the areas in which stress concentrates during crimping, making it possible to suppress the occurrence of cracking.

Further, the depressions may also include a plurality of small depressions. Thus, a metal constituting the conductor wire flows into the small depressions, thereby more firmly preventing the conductor wire from coming out of the crimping portion.

Further, the length of the small depressions in the circumferential direction are changed according to a position of the crimping portion in the circumferential direction, making it possible to obtain an embodiment in consideration of a deformation direction during the crimping of the crimping portion. For example, an area in which a deformation in the tensile direction progresses in the circumferential direction during crimping can be made shorter in the circumferential direction in advance, and an area in which a deformation in the compression direction progresses in the circumferential direction during crimping can be made longer in the circumferential direction in advance, thereby enabling the lengths in the circumferential direction after crimping to be substantially uniform.

A second aspect of the invention is a wire harness that connects a covered conductor wire and a terminal, the terminal including a terminal main body and a cylindrical crimping portion. The crimping portion includes a cover crimping portion that crimps a covering portion and a conductor wire crimping portion that crimps a conductor wire exposed from the covering portion, and is sealed in all areas excluding an area of insertion of the covered conductor wire. The conductor wire crimping portion includes a plurality of depressions on an inner surface thereof, the depressions including main depressions formed in a plurality of rows in an axial direction of the conductor wire crimping portion, at a substantial center in the axial direction of the conductor wire crimping portion, and sub-depressions formed on both sides of the main depressions. The main depressions are formed substantially across an entire periphery of the wire crimping portion, and the sub-depressions have a formation range shorter than that of the main depressions, and are not formed above the wire crimping portion. The conductor wire crimping portion includes a straight portion at a substantial center in the axial direction of the conductor wire crimping portion, the straight portion having high compressibility, and tapered portions on both sides of the straight portion in the axial direction of the conductor wire crimping portion. The main depressions are positioned in the straight portion, and the sub-depressions are positioned in each boundary portion between the straight portion and the tapered portions. The conductor wire may be made of an aluminum-based material.

According to the second aspect of the invention, a thin area is not formed during crimping in the stress concentration areas at each boundary between the straight portion and the tapered portions of the die described above, making it possible to obtain a wire harness with excellent reliability.

A third aspect of the invention is a terminal and covered conductor wire connection method in which the terminal includes a terminal main body and a cylindrical crimping portion, the crimping portion includes a cover crimping portion that crimps a covering portion and a conductor wire crimping portion that crimps a conductor wire exposed from the covering portion, the crimping portion being sealed in all areas excluding an area through which the covered conductor wire is inserted, and the conductor wire crimping portion includes a plurality of depressions on the inner surface thereof, the depressions being formed in a plurality of rows in the axial direction of the conductor wire crimping portion and including main depressions formed at a substantial center in the axial direction of the conductor wire crimping portion and sub-depressions formed on both sides of the main depressions, the main depressions being formed substantially across the entire periphery of the wire crimping portion, and the sub-depressions having a formation range shorter than that of the main depressions and not being formed on the upper side of the wire crimping portion. The method includes the steps of inserting the covered conductor wire into the crimping portion, and crimping the conductor wire crimping portion using a die, wherein the die includes a straight portion in an area corresponding to a substantial center in the axial direction of the conductor wire crimping portion and tapered portions in areas corresponding to both sides of the straight portion in the axial direction of the conductor wire crimping portion, the die compressing an area having the main depressions disposed therein at the straight portion, and areas having the sub-depressions disposed therein at each boundary portion between the straight portion and the tapered portions.

According to the third aspect of the invention, it is possible to obtain a terminal capable of suppressing the occurrence of terminal cracking during crimping and a covered conductor wire connection method.

A fourth aspect of the invention is a wire harness structure including a plurality of wire harnesses tied in a bundle, each of the wire harnesses including a covered conductor wire and a terminal that are connected with each other. The terminal includes a terminal main body and a cylindrical crimping portion, the crimping portion including a cover crimping portion that crimps a covering portion and a conductor wire crimping portion that crimps a conductor wire exposed from the covering portion, and the crimping portion being sealed in all areas excluding an area through which the covered conductor wire is inserted. The conductor wire crimping portion includes a plurality of depressions on the inner surface thereof, the depressions being formed in a plurality of rows in the axial direction of the conductor wire crimping portion and including main depressions formed at a substantial center in the axial direction of the conductor wire crimping portion and sub-depressions formed on both sides of the main depressions. The main depressions are formed substantially across the entire periphery of the wire crimping portion, and the sub-depressions have a formation range shorter than that of the main depressions and are not formed on the upper side of the wire crimping portion.

In the present invention, the plurality of wire harnesses may be tied in a bundle and used.

Advantageous Effects of Invention

According to the present invention, it is possible to provide a terminal or the like capable of suppressing cracking in a crimping portion.

BRIEF DESCRIPTION OF DRAWINGS

FIG. 21A is a diagram for explaining a compressing step illustrated in

FIG. 19D, and FIG. 21B is a diagram for explaining a compressing step in FIG. 19E.

DESCRIPTION OF EMBODIMENTS

Figure 1:
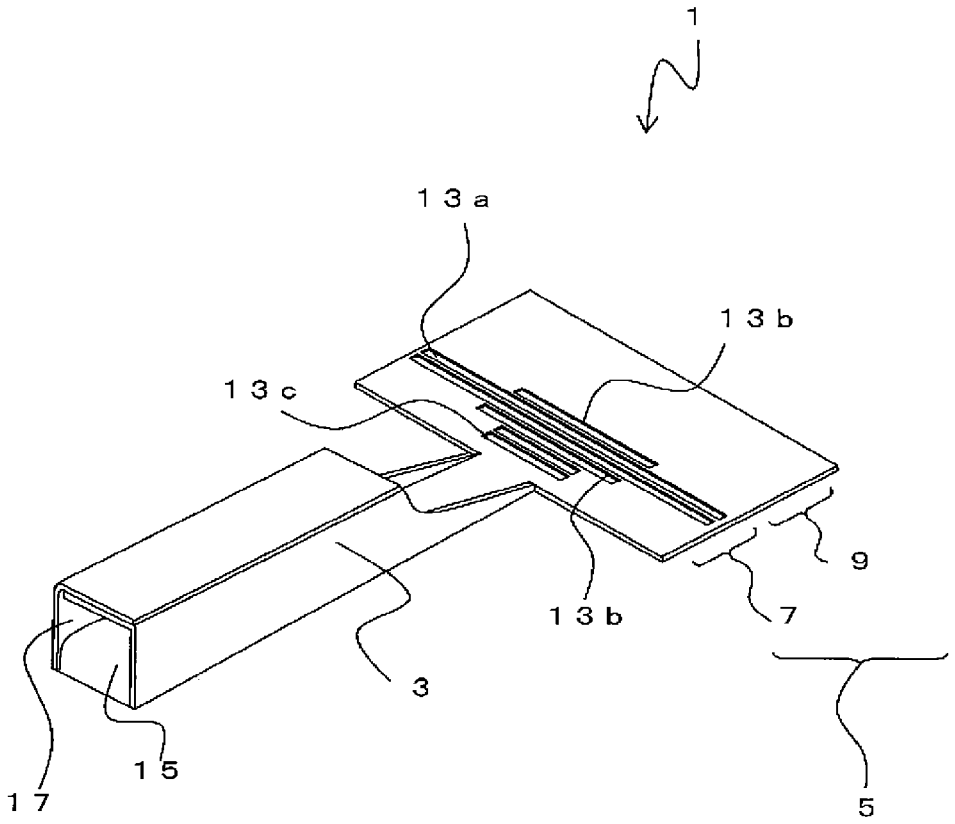
FIG. 1 is a diagram of a partially unfolded terminal 1.

A first embodiment of the present invention will be described in detail hereinafter on the basis of the drawings. FIG. 1 is a diagram illustrating a portion of a terminal 1 in an unfolded state, and FIG. 2 is a cross-sectional view of the terminal 1.

Figure 2:
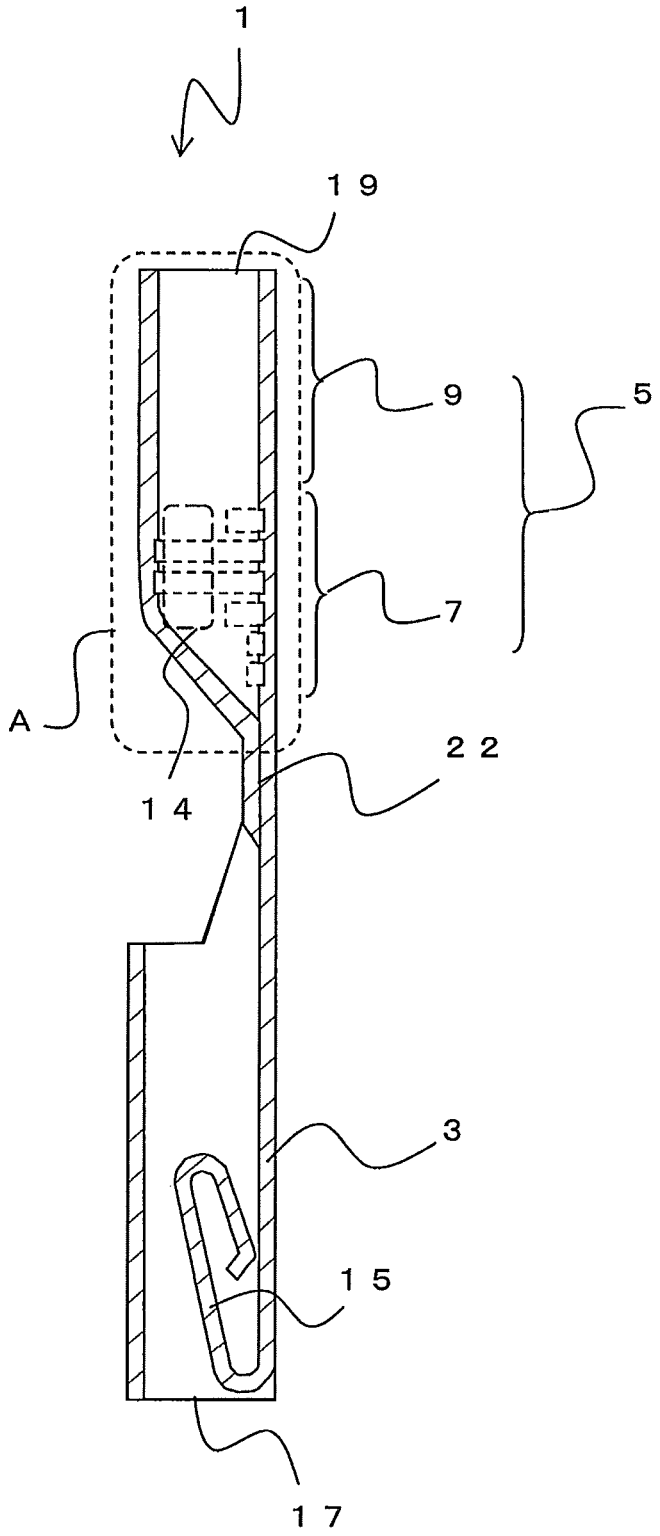
FIG. 2 is a cross-sectional view of the terminal 1.

As illustrated in FIGS. 1 and 2, the terminal 1 is composed of a terminal main body 3 and a crimping portion 5. The terminal 1 is made of copper. The terminal main body 3 is obtained by forming a plate material having a predetermined shape into a cylindrical body having a rectangular cross section, as illustrated in FIG. 1. The terminal main body 3 includes an elastic contact piece 15 at a front end portion 17. The elastic contact piece 15 is formed by folding the plate material to the inside of the rectangular cylindrical body. A male terminal or the like is inserted into the terminal main body 3 from the front end portion 17, thereby making a connection.

The crimping portion 5 is formed by being rolled into a cylindrical body having a circular cross section and joining the side edge portions of the crimping portion 5 together. It should be noted that a side (left side of FIG. 2) on which edge end portions of the crimping portion 5 are joined is the upper side 14 of the terminal, and the opposite side (right side of FIG. 2) is the lower side of the terminal. That is, the side on which depressions 13*c* described later are formed is the lower side of the terminal. A covered conductor wire 23 described later is inserted from a rear end portion 19 of the crimping portion 5 formed into a cylindrical shape. The crimping portion 5 is composed of a cover crimping portion 9 and a conductor wire crimping portion 7. The cover crimping portion 9 is an area that crimps a covering portion of the covered conductor wire described later. The conductor wire crimping portion 7 is an area that crimps a conductor wire 25 exposed upon peeling the covering portion of the covered wire.

It should be noted that while the crimping portion 5 has been formed into a cylindrical shape having substantially the same circular cross section across the entire length thereof, the diameter of the crimping portion 5 may change in a plurality of stages on the terminal main body 3 side, from the rear end portion 19. For example, the inner diameter of the conductor wire crimping portion 7 may be slightly smaller than the inner diameter of the cover crimping portion 9.

On the conductor wire crimping portion 7, depressions 13*a*, 13*b*, 13*c* serving as linear locking portions are provided at prescribed intervals in the axial direction of the crimping portion 5. The depressions 13*a*, 13*b*, 13*c* are continuous grooves that are depressed on the inner surface of the crimping portion 5.

As illustrated in FIG. 1, the depressions 13*a* serving as main depressions are formed substantially across the entirety of the crimping portion 5 in the width direction (circumferential direction of the cylindrical shape). It should be noted that both edge portions of the crimping portion 5 in the width direction are welded portions, and therefore the depressions 13*a* are formed up to an area slightly in front of the edge portion. The depressions 13*b* serving as sub-depressions are shorter than the depressions 13*a*. For example, the length of the depressions 13*b* is about half the length of the depressions 13*a*. Therefore, when the crimping portion 5 is formed into a cylindrical shape, the depressions 13*b* are formed at a semi-circular section of a substantially lower half of the cylinder. The depressions 13*c* are even shorter than the depressions 13*b*. The depressions 13*c* are, for example, formed to have a width that is almost identical to the width of the bottom surface of the terminal main body 3.

Figure 3:
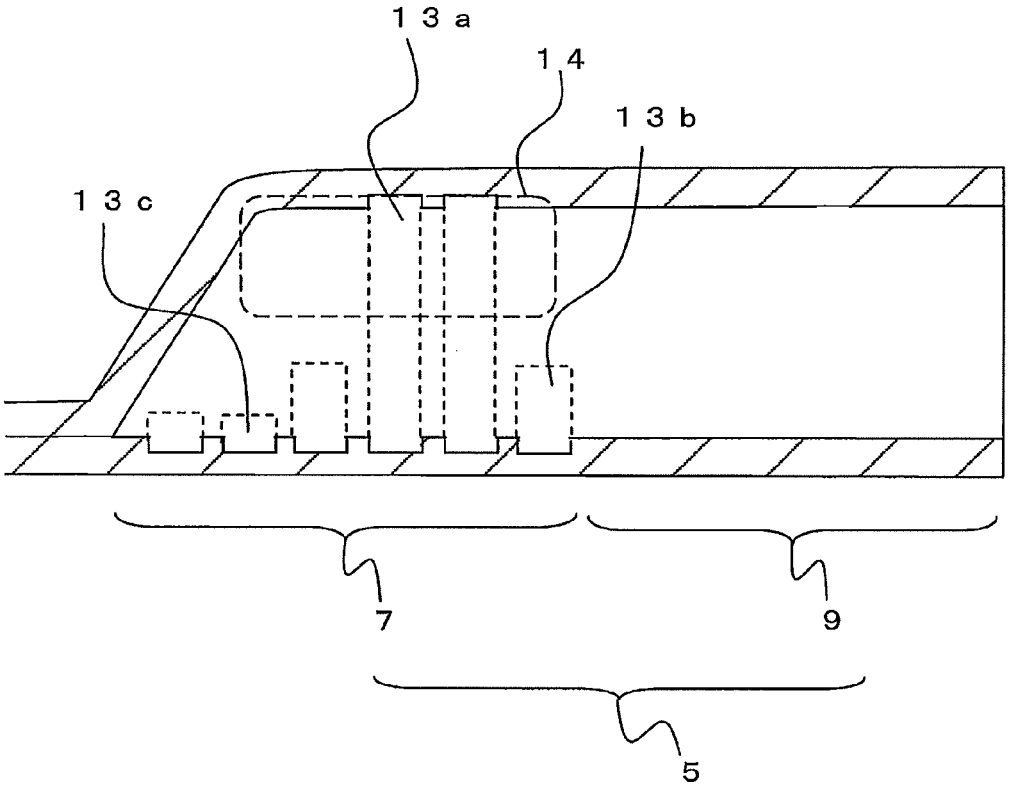
FIG. 3 is a cross-sectional view of the terminal 1, illustrating an enlarged view of the area A in FIG. 2.

FIG. 3 is an enlarged view of the area A in FIG. 2. The depressions 13*a* are formed in the vicinity of the center of the conductor wire crimping portion 7 in the axial direction of the crimping portion 5 (left-right direction in FIG. 3 and the insertion direction of the covered conductor wire). The depressions 13*b* are formed on both sides (front and back sides) of the depressions 13*a* in the axial direction of the crimping portion 5. The depressions 13*c* are formed in front of the depressions 13*b* (on the terminal main body 3 side). It should be noted that the number of each of the depressions 13*a*, 13*b*, 13*c* is not limited to the number in the illustrated examples, and is designed as appropriate.

Figure 4:
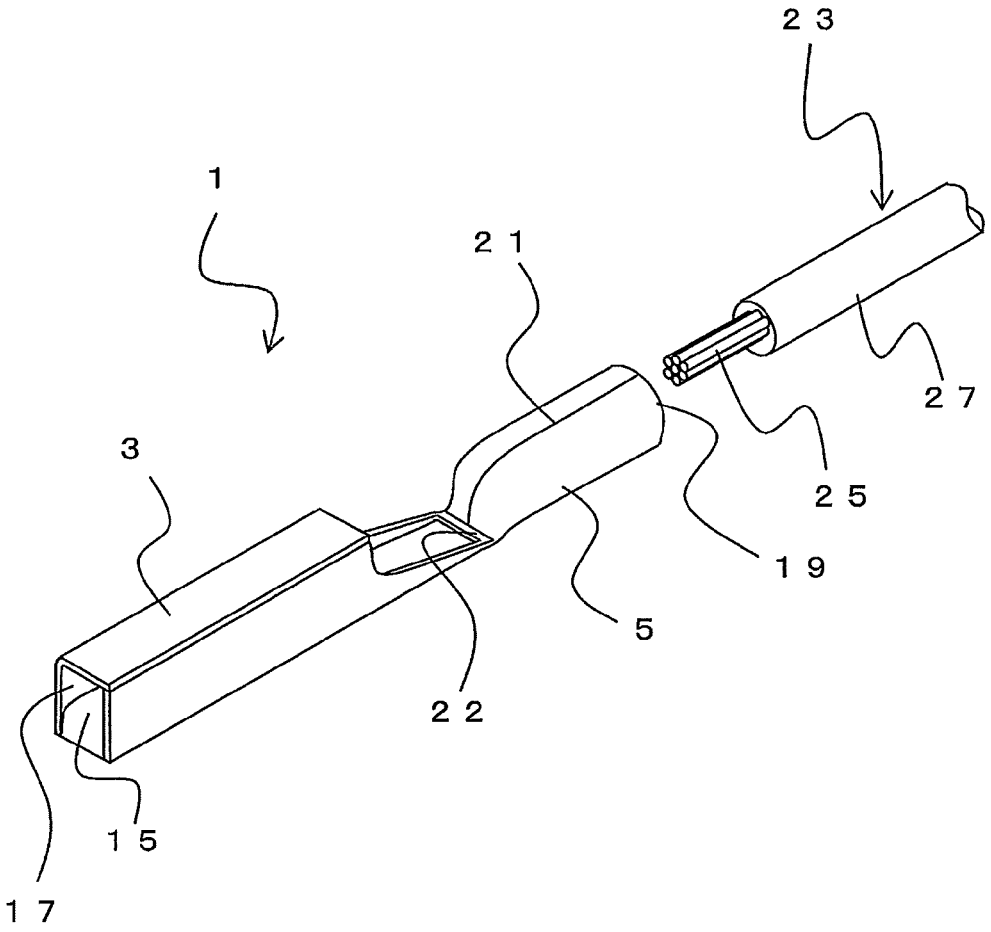
FIG. 4 is an exploded perspective view of the terminal 1 and a covered conductor wire 23.

FIG. 4 is a diagram illustrating a step of forming a wire harness in which the covered conductor wire 23 is inserted into the tubular crimping portion 5. As described above, the crimping portion 5 is rounded into a substantially cylindrical shape, and the edge portions thereof are joined at a joining portion 21. Further, a sealing portion 22 is provided on a front end portion (terminal main body 3 side) of the crimping portion 5. That is, the crimping portion 5 is sealed except for the rear end portion 19 into which the covered conductor wire 23 is inserted. It should be noted that the joining portion 21 and the sealing portion 22 are welded by laser welding, for example.

The covered conductor wire 23 includes the conductor wire 25 covered by an insulating covering portion 27. When the covered conductor wire 23 is inserted into the crimping portion 5, a portion of the covering portion 27 at the tip of the covered conductor wire 23 is peeled off, exposing the conductor wire 25. It should be noted that the material of the covering portion 27 can be selected from those normally used in this technical field, including polyvinyl chloride (PVC), polyethylene, and the like.

Thus, it is possible to seal the crimping portion 5 by bringing the cover crimping portion 9 and the covering portion 27 into intimate contact with each other after the crimping described later. At this time, the crimping portion 5, excluding the rear end portion 19, is sealed to be watertight by the joining portion 21 and the sealing portion 22, thereby making it possible to prevent penetration of moisture into the crimping portion 5.

Figure 5A:
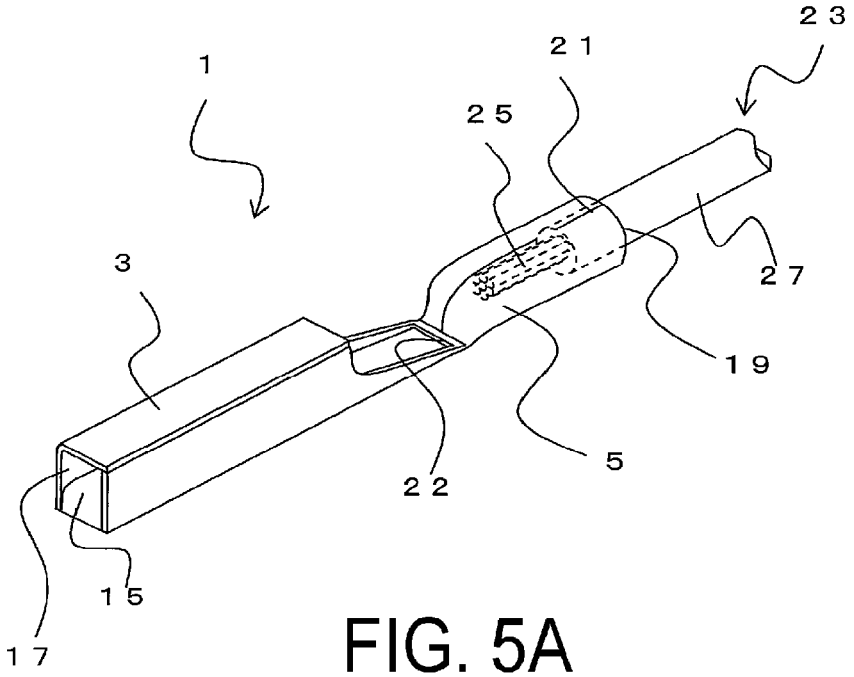
FIGS. 5A and 5B are diagrams of the covered conductor wire 23 inserted into the terminal 1, FIG. 5A being a perspective view and FIG. 5B being a partial cross-sectional view.
Figure 5B:
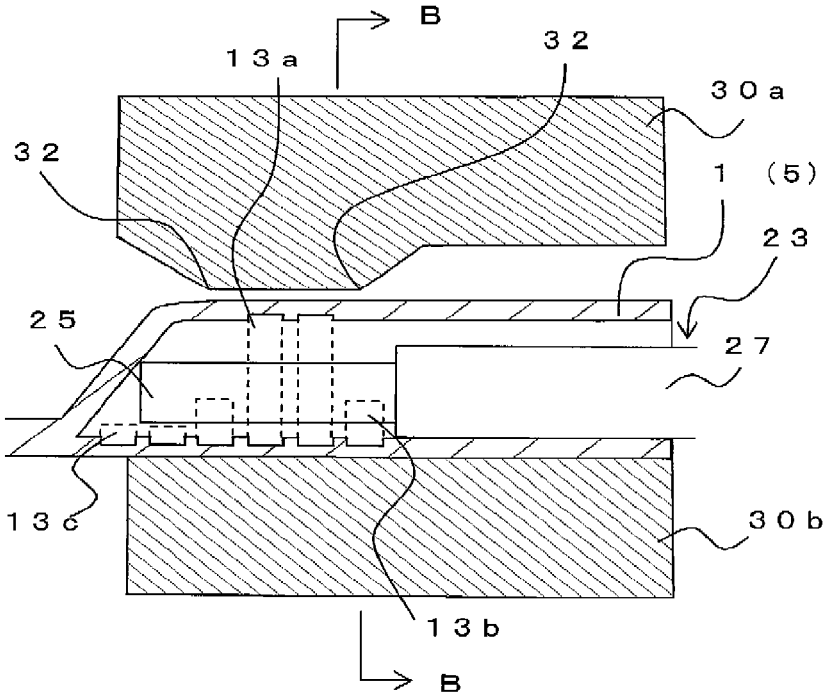
Figure 6:
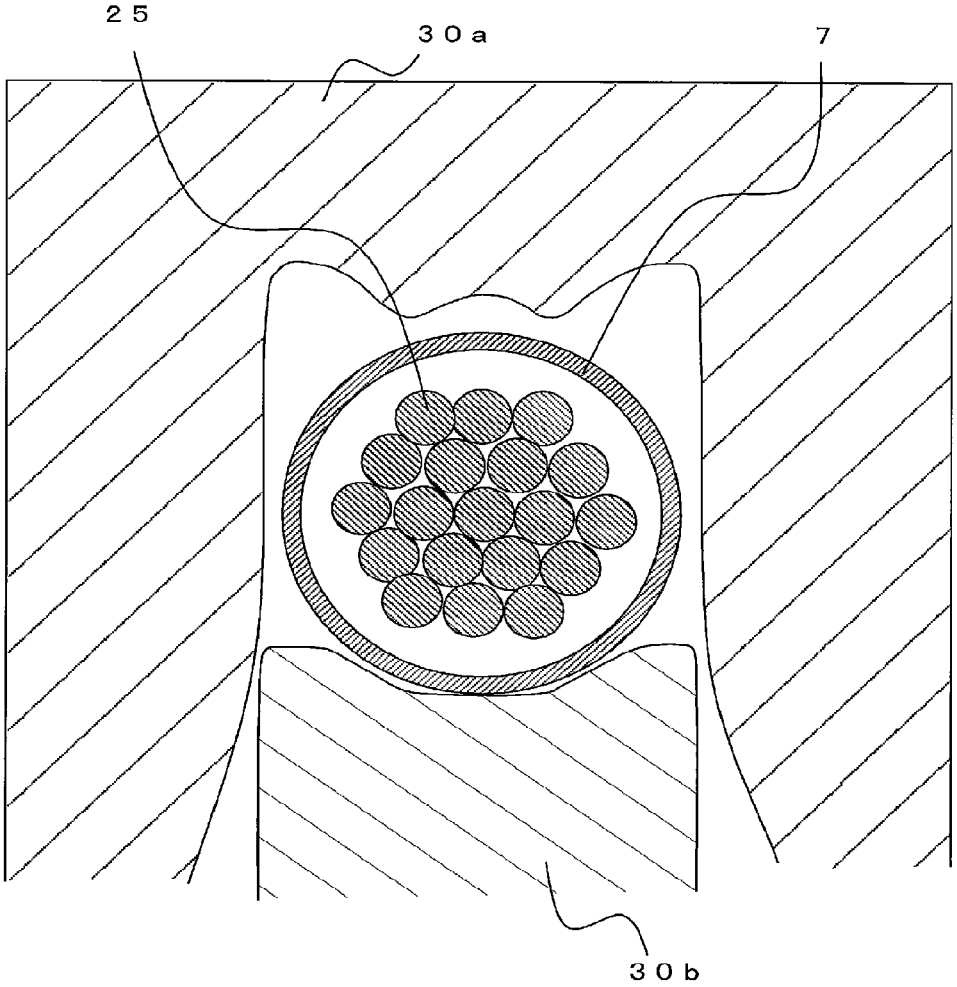
FIG. 6 is a cross-sectional view of an upper die 30*a* and a lower die 30*b*, the view being taken along the line B-B in FIG. 5B.

Next, as illustrated in FIG. 5A, the tip of the covered conductor wire 23 is inserted into the crimping portion 5. FIG. 5B is a partial cross-sectional view of the crimping portion 5 with an upper die 30*a* and a lower die 30*b* that crimp the crimping portion 5 arranged, and FIG. 6 is a cross-sectional view taken along the line B-B in FIG. 5B.

On the upper die 30*a*, a straight portion having a substantially straight cross section in the axial direction of the crimping portion 5 is formed in an area corresponding to the conductor wire crimping portion 7, and tapered portions are formed at the front and back of the straight portion. That is, the upper die 30*a* is formed into an inverted trapezoid shape in which a substantially center portion in the crimping direction protrudes. Therefore, the straight portion has high compressibility and serves as a strong crimping portion. A die angled portion 32 is formed at the boundary between the straight portion and each of the tapered portions. The depressions 13*a* are provided in the area corresponding to the straight portion of the upper die 30*a*, and the depressions 13*b* are provided in areas corresponding to the die angled portions 32.

Figure 7A:
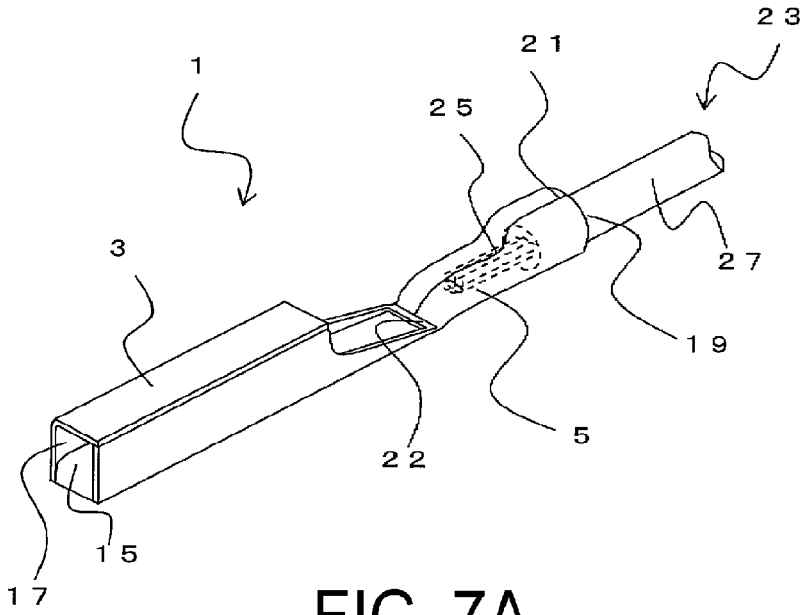
FIGS. 7A and 7B are diagrams of the terminal 1 and the covered conductor wire 23 in a crimped state, FIG. 7A being a perspective view and FIG. 7B being a partial cross-sectional view.
Figure 7B:
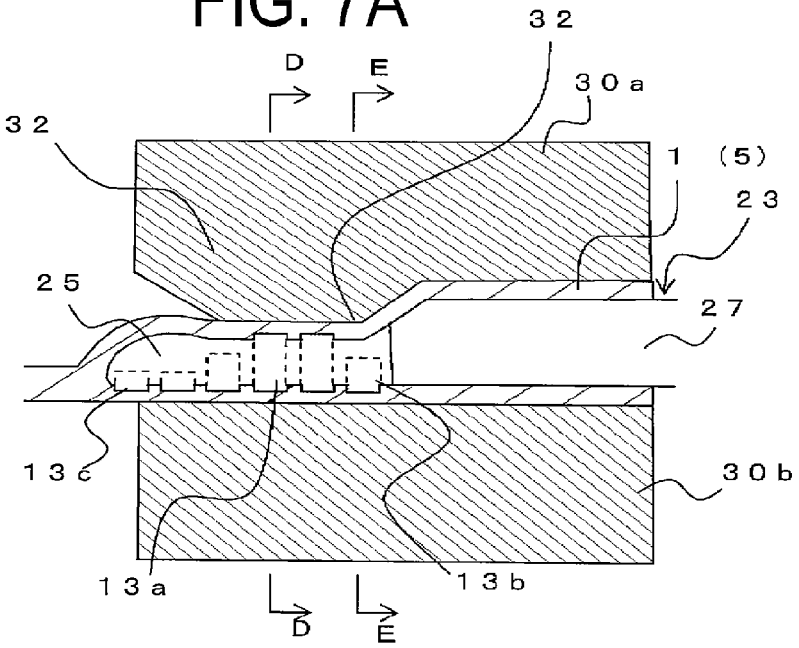
Figure 8:
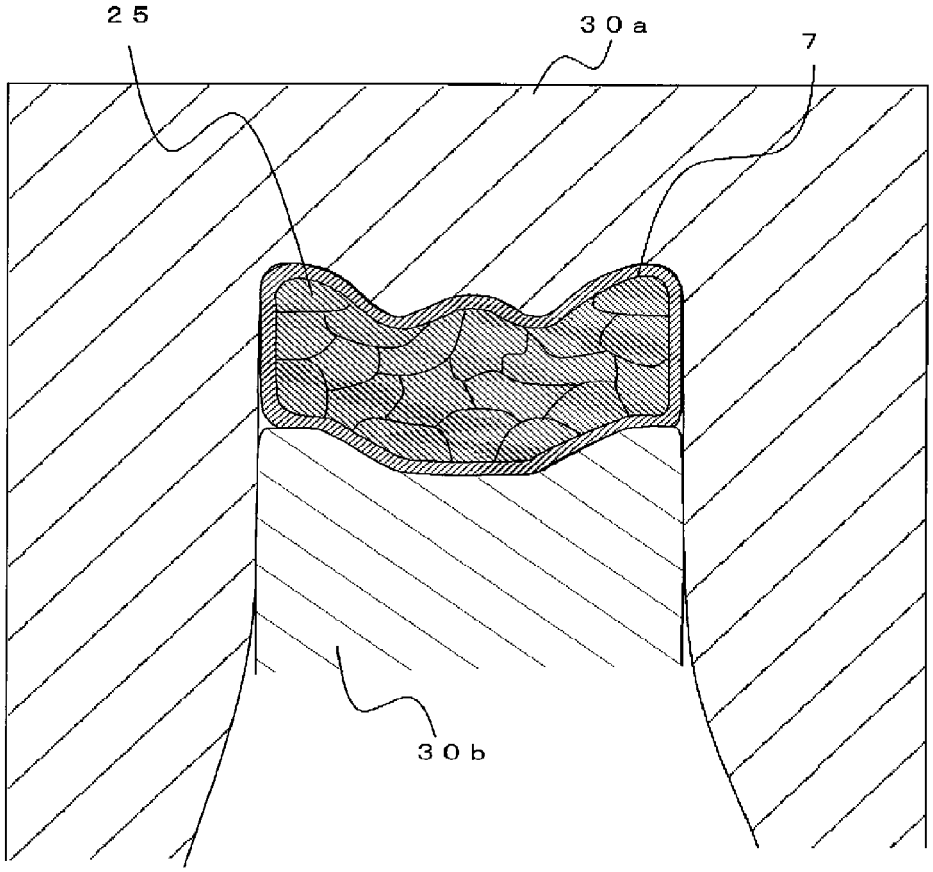
FIG. 8 is a cross-sectional view of the upper die 30*a* and the lower die 30*b*, the view being taken along the line C-C in FIG. 5A.

FIG. 7A is a perspective view of a wire harness onto which the crimping portion 5 is crimped, FIG. 7B is a cross-sectional view of the wire harness along with the upper die 30*a* and the lower die 30*b* during crimping, and FIG. 8 is a cross-sectional view (depressions are not illustrated) taken along the line D-D in FIG. 7B. The crimping portion 5 is clamped by the upper die 30*a* and the lower die 30*b*, thereby crimping the conductor wire crimping portion 7 and the conductor wire 25.

Figure 9A:
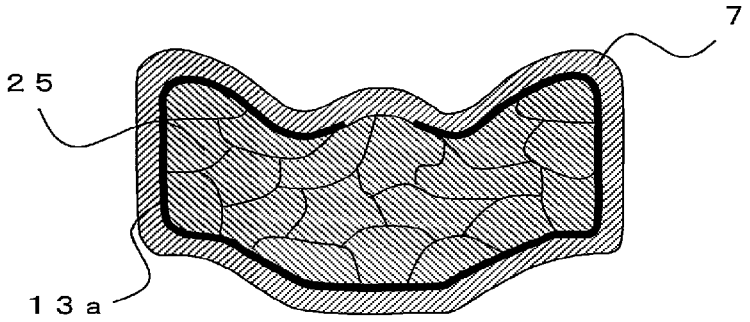
FIG. 9A is a diagram illustrating a position of a depression 13*a* after crimping, the diagram being a cross-sectional view taken along the line D-D in FIG. 7B.
Figure 9B:
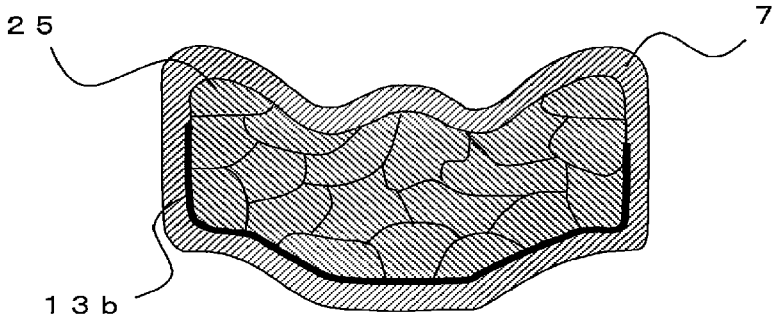
FIG. 9B is a diagram illustrating a position of a depression 13*b* after crimping, the diagram being a cross-sectional view taken along the line E-E in FIG. 7B.

FIGS. 9A and 9B are cross-sectional views (dies not illustrated) of the conductor wire crimping portion 7 in a crimped state. FIG. 9A is a cross-sectional view, taken along the line D-D in FIG. 7B, at the position of the depression 13*a*, and FIG. 9B is a cross-sectional view, taken along the line E-E in FIG. 7B, at the position of the depression 13*b*. The conductor wire 25 flows as being pressed into the depressions 13*a*, 13*b*, 13*c*. Pressing the conductor wire 25 into the depressions 13*a*, 13*b*, 13*c* makes it possible to ensure a high crimping force. Further, a surface of the conductor wire 25 flows, thereby destroying the oxide film on the surface. This makes it possible to decrease electrical resistance between the conductor wire 25 and the conductor wire crimping portion 7. Such an effect is particularly exhibited if the conductor wire 25 is made of an aluminum-based material.

As illustrated in FIG. 9A, in the area crimped by the straight portion of the upper die 30*a*, the depressions 13*a* are formed substantially across the entire periphery of the conductor wire crimping portion 7. Therefore, the conductor wire 25 flows into the depressions 13*a*, making it possible to retain the conductor wire 25 substantially across the entire periphery of the conductor wire crimping portion 7.

Meanwhile, the depressions 13*b* are formed in the areas crimped by the die angled portions 32. The die angled portions 32 are areas in which stress concentrates during crimping. Thus, cracking readily occurs in the areas corresponding to the die angled portions 32 when the areas are crimped by the upper die 30*a*. Therefore, when the positions in which the depressions 13*b* are formed are compressed by the die angled portions 32, areas thinned by the depressions 13*b* increase in susceptibility to cracking. In the present invention, the depressions 13*b* are not formed in shape changing areas (stress concentration areas, such as stepped portions and bent portions, formed by the dies) on front and rear end sides of the conductor wire crimping portion 7 in the longitudinal direction of the terminal. It should be noted that shape changes occur in some areas (that is, contact portions that comes into contact with the die 30*a*) in the circumferential direction of the conductor wire crimping portion 7, and therefore the depressions 13*b* are formed in at least some of the other areas (that is, contact portions that come into contact with the die 30*b*) in the circumferential direction of the shape changing portions. Thus, the depressions 13*b* are formed only in positions in the circumferential direction without shape changes. On the other hand, in areas without shape changing portions across the entire periphery in the circumferential direction, the depressions 13*a* are formed across substantially the entire periphery. Thus, the depressions 13*b* are formed only in a substantially lower semi-circular section which is not a shape changing portion of the conductor wire crimping portion 7 in the longitudinal direction of the terminal, whereas no depressions 13*b* are formed on the upper surface (upper side 14) of the conductor wire crimping portion 7, which is a shape changing portion. Thus, thin portions are not formed in the areas corresponding to the die angled portions 32, making it possible to suppress the occurrence of cracking.

It should be noted that when the conductor wire 25 is crimped, the conductor wire 25 is extended in the axial direction. Therefore, the conductor wire 25 flows toward the front end portion of the crimping portion 5. An area near the tip portion of the flowed conductor wire 25 is pressed into the depressions 13*c*, retaining the conductor wire 25. It should be noted that, in the present invention, the depressions 13*b* in the areas corresponding to the die angled portions 32 are shorter than those in other areas, and the depressions 13*b* need not be disposed on the upper surface of the conductor wire crimping portion 7. Therefore, the depressions 13*c* are not necessarily required, and may be formed on substantially the entire periphery of the crimping portion 5.

Thus, in the first embodiment, the conductor wire 25 is pressed into the depressions 13*a*, 13*b*, 13*c*, making it possible to reliably retain the conductor wire 25. Further, the depressions 13*b* are provided in the areas corresponding to the die angled portions 32 of the conductor wire crimping portion 7. The depressions 13*b* are formed in about the lower semi-circular section, and not continuously to the upper surface of the crimping portion 5. This makes it possible to prevent formation of thin portions in areas compressed by the die angled portions 32. Thus, it is possible to suppress the occurrence of cracking in the crimping portion 5 by the die angled portions 32.

Figure 10:
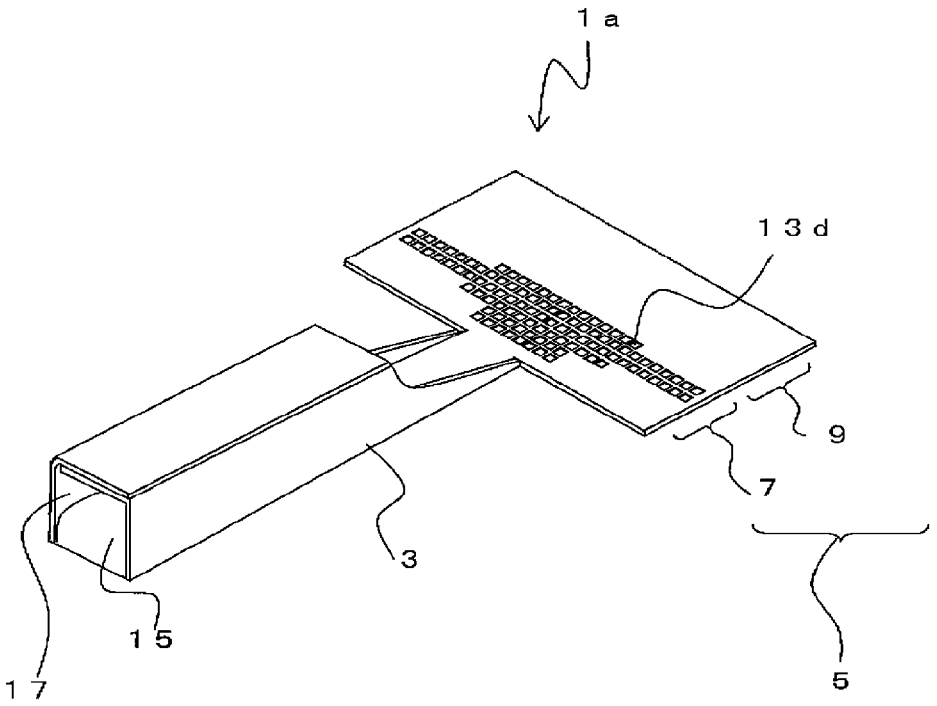
FIG. 10 is a perspective view of a partially unfolded terminal 1*a*.
Figure 11:
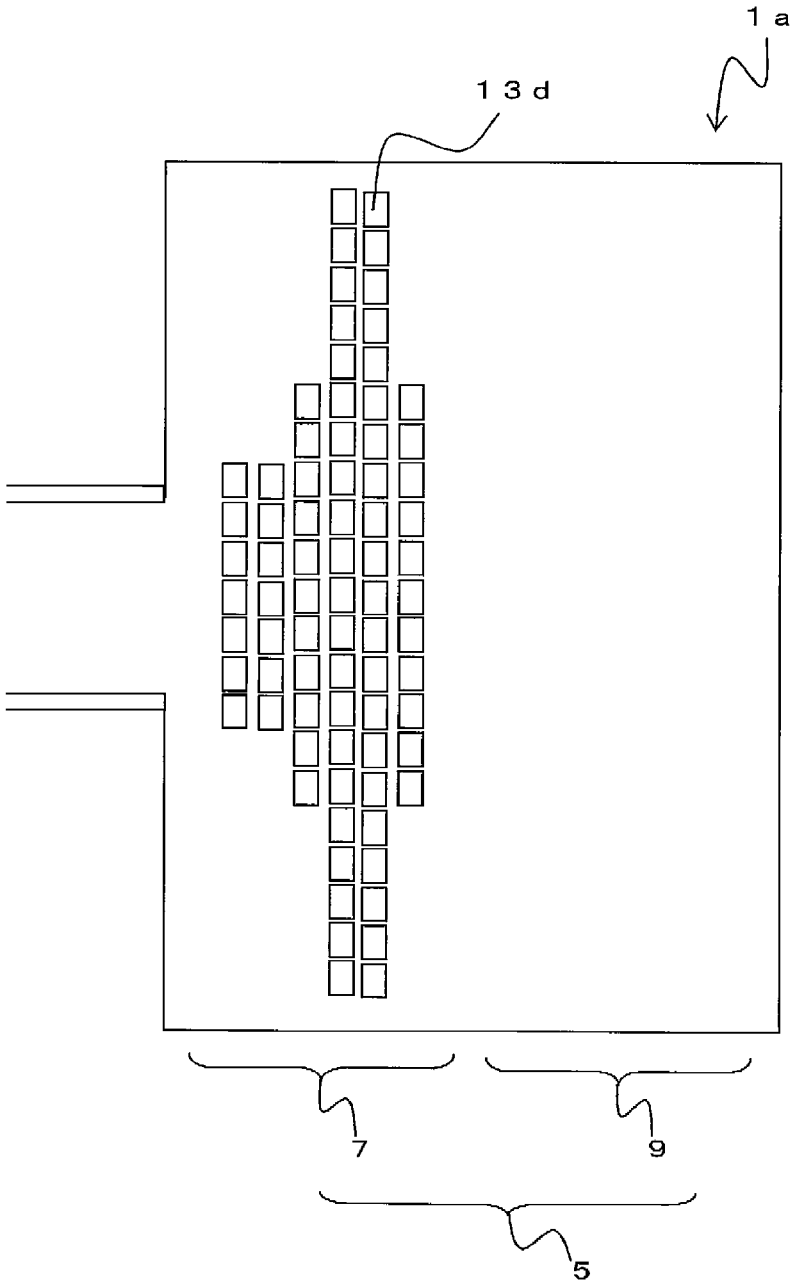
FIG. 11 is a partial plan view of a partially unfolded terminal 1*a*.

Next, a second embodiment will be described. FIG. 10 is a partial development view of a terminal 1*a*, and FIG. 11 is a partial plan view thereof. It should be noted that, in the description below, components that perform functions identical to those of terminal 1 are denoted using the same symbols as those in FIGS. 1 to 9B, and duplicate descriptions thereof will be omitted. The terminal 1*a* has substantially the same configuration as that of terminal 1, but differs in the form of the depressions.

The terminal 1*a* differs from terminal 1 in that the depressions are not continuously linear, but rather formed by a plurality of small depressions 13*d*. The plurality of small depressions 13*d* are provided at prescribed intervals in the width direction (the circumferential direction after having been formed into a cylindrical shape) of the crimping portion 5. Each of the small depressions 13*d* has a substantially rectangular (or substantially square) shape.

A range in which the small depressions 13*d* are provided is similar to that of the depressions 13*a*, 13*b*, 13*c* of the terminal 1. That is, during crimping, the small depressions 13*d* are provided across substantially the entire periphery of the crimping portion 5 (that is, the range corresponding to the depressions 13*a* of the terminal 1) in the area corresponding to the straight portion of the upper die 30*a* described above, and disposed in a shorter range (that is, the range corresponding to the depressions 13*b* of the terminal 1) in the areas corresponding to the die angled portions 32. Furthermore, the small depressions 13*d* are similarly disposed in the range corresponding to the depressions 13*c* of the terminal 1.

Thus, in the present embodiment, the depressions are formed by the plurality of small depressions 13*d*, and therefore, when the conductor wire has flowed, the metal is pressed in segments into each of the small depressions 13*d*. As a result, it is possible to make the surface of the conductor wire 25 flow more complexly during crimping with the terminal 1*a* than with the terminal 1 having continuous depressions, thereby making it possible to facilitate the destruction of the surface oxide film and maintain a high crimping force.

Figure 12:
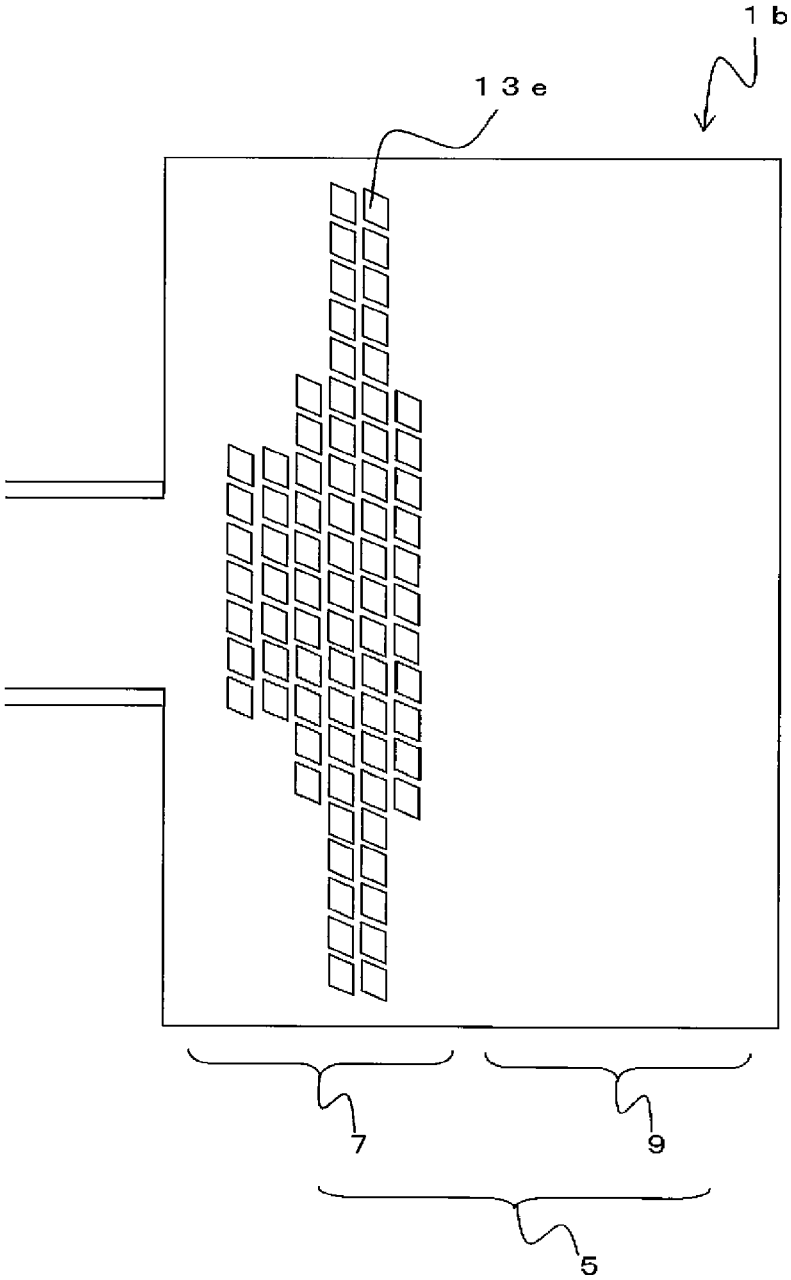
FIG. 12 is a partial plan view of a partially unfolded terminal 1*b*.

It should be noted that, in place of the small depressions 13*d*, small depressions 13*e* may be used as in a terminal 1*b* illustrated in FIG. 12. The terminal 1*b* is the same as the terminal 1*a* except that the small depressions 13*e* are formed in a parallelogram shape. That is, the plurality of small depressions 13*e* are provided and formed in predetermined ranges.

Thus, according to the second embodiment as well, it is possible to achieve an effect similar to that of the first embodiment. Further, by providing the small depressions 13*d*, 13*e* and forming depressions in predetermined ranges, the flow of the surface of the conductor wire 25 becomes more complex, making it possible to facilitate the destruction of the oxide film and maintain a high crimping force.

Figure 13:
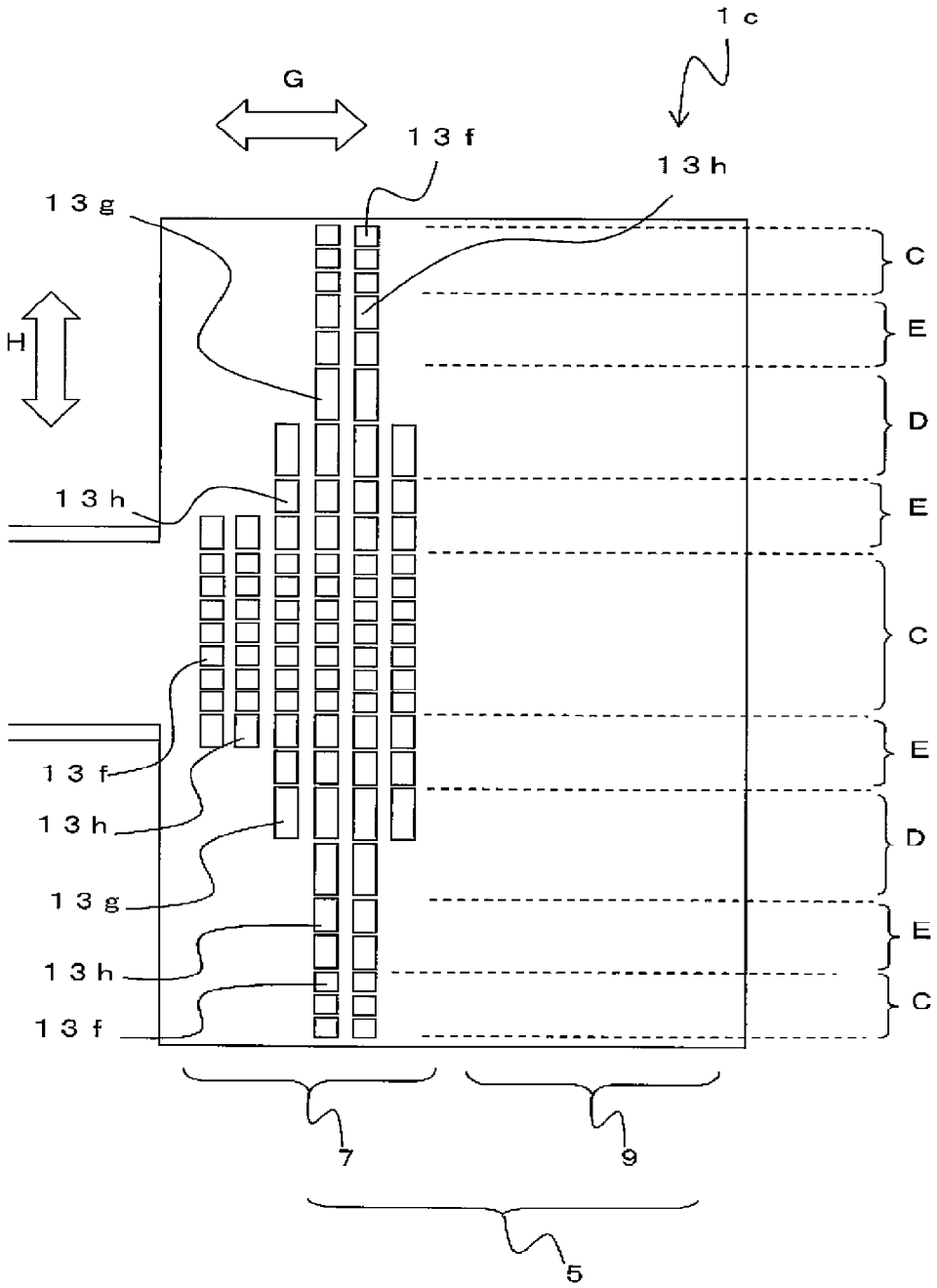
FIG. 13 is a partial plan view of a partially unfolded terminal 1*c*.

Next, a third embodiment will be described. FIG. 13 is a partial plan view of a terminal 1*c* in an unfolded state. The terminal 1*c*, similar to the terminals 1*a*, 1*b*, includes depressions formed by a plurality of small depressions, but differs in that small depressions 13*f*, 13*g*, 13*h* are provided in place of the small depressions 13*d*, 13*e*.

The ranges in which the small depressions 13*f*, 13*g*, 13*h* are provided are substantially the same as the ranges in which the depressions 13*a*, 13*b*, 13*c* of the terminal 1 are provided. That is, the ranges are substantially the same as the ranges in which the small depressions 13*d*, 13*e* of the terminals 1*a*, 1*b* are provided.

The small depressions 13*f*, 13*g*, 13*h* have substantially the same lengths in the axial direction of the crimping portion 5 (in the arrow G direction in the drawing), but have different lengths in the width direction of the crimping portion 5 (in the circumferential direction after having been formed into a cylindrical shape; the arrow H direction in the drawing).

Figure 14A:
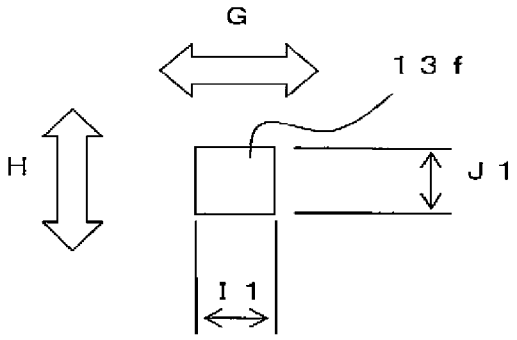
FIG. 14A is a diagram of a small depression 13*f*.
Figure 14B:
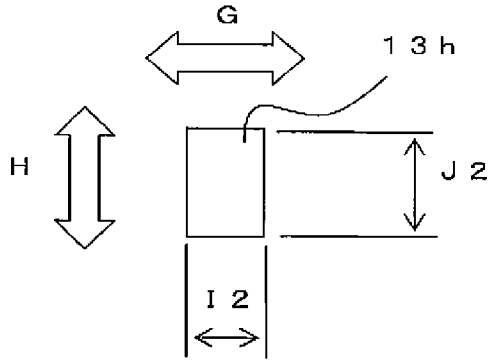
FIG. 14B is a diagram of a small depression 13*h*.
Figure 14C:
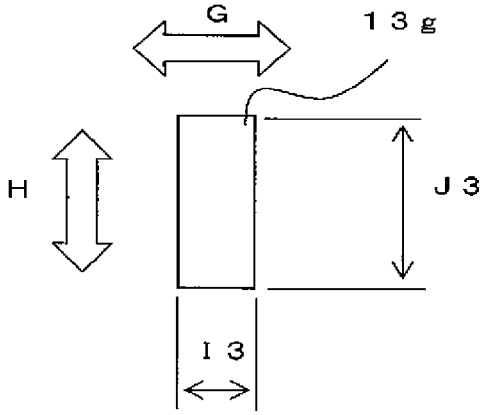
FIG. 14C is a diagram of a small depression 13*g*.

FIGS. 14A to 14C are enlarged views of the small depressions 13*f*, 13*g*, 13*h*. As illustrated in FIG. 14A, the length (length in the arrow G direction in the drawing; hereinafter the same) of each of the small depressions 13*f* serving as first depressions is referred to as I1, and the width (circumferential direction length, which is a length in the arrow H direction in the drawing, hereinafter the same) is referred to as J1. Further, as illustrated in FIG. 14B, the length of each of the small depressions 13*h* serving as second depressions is referred to as I2, and the width (circumferential direction length) is referred to as J2. Further, as illustrated in FIG. 14C, the length of each of the small depressions 13*g* serving as third depressions is referred to as I3, and the width (circumferential direction length) is referred to as J3. In this case, I1≈I2≈I3 and the relationship J3>J2>J1 is satisfied.

As illustrated in FIG. 13, the small depressions 13*f* are provided in a substantially center portion in the width (circumferential) direction of the crimping portion 5 (in the region C in the drawing). Further, the small depressions 13*h* are provided on both sides of the region C in the substantial center (in the regions E in the drawing). Further, the small depressions 13*g* are further provided on both sides of the regions E (in the regions D in the drawing). Further, the small depressions 13*h*, 13*f* are provided in that order on both sides of the regions D (in the regions E, C in the drawing). That is, the crimping portion 5 is segmented into the regions C, E, D, E, C that are arranged in that order from the center portion, and the small depressions 13*f* are provided in the regions C, the small depressions 13*g* are provided in the regions D, and the small depressions 13*h* are provided in the regions E.

Figure 15:
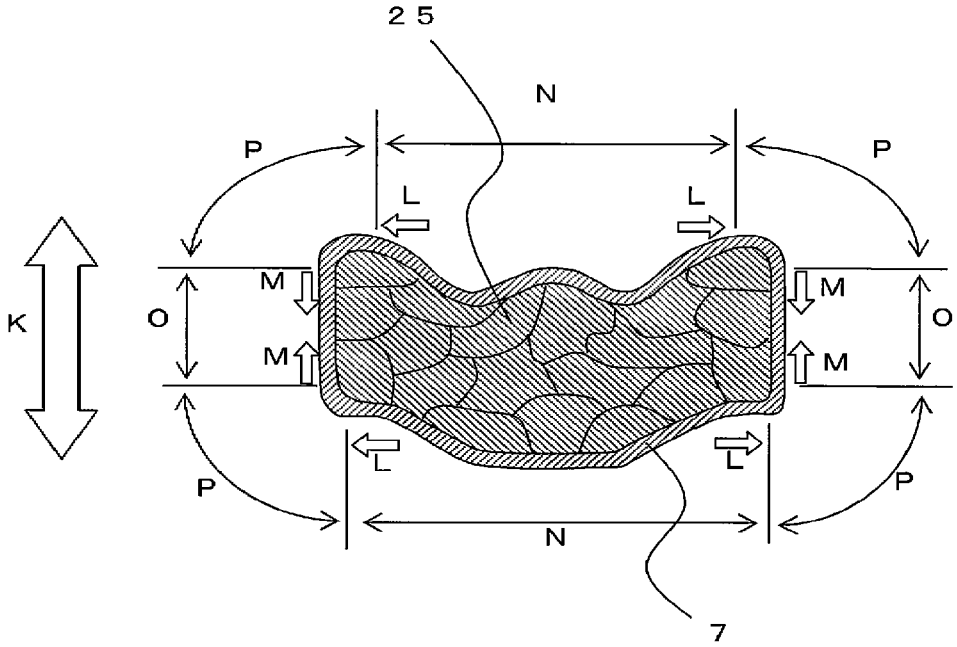
FIG. 15 is a cross-sectional view of the terminal after crimping.

FIG. 15 is a cross-sectional view of the conductor wire crimping portion 7 after crimping. When the conductor wire crimping portion 7 having the small depressions disposed therein is thus crimped by the dies as described above, the conductor wire crimping portion 7 is deformed as illustrated in FIG. 15. Here, the cross section of the conductor wire crimping portion 7 is crushed in the crimping direction (the arrow K direction in the drawing). At this time, the conductor wire crimping portion 7 is segmented into substantially upper and lower surfaces (regions N in the drawing) in the crimping direction, both side surfaces (regions O in the drawing) serving as surfaces substantially orthogonal to the crimping direction, and ranges P corresponding to substantially corner portions between the regions N and O.

In this case, the regions N are subjected to tensile deformation in the circumferential direction during crimping (in the arrow L directions in the drawing). Meanwhile, the regions O are subjected to compressive deformation in the circumferential direction during crimping (in the arrow M directions in the drawing). Further, the regions P, which are between the regions N and O, are areas in which tensile deformation and compressive deformation substantially do not occur.

Here, in the development view illustrated in FIG. 13, when both edge portions of the crimping portion 5 are joined and the crimping portion 5 is made into a cylindrical shape, the regions C of the conductor wire crimping portion 7 correspond to the regions N, the regions D of the conductor wire crimping portion 7 correspond to the regions O, and the regions E of the conductor wire crimping portion 7 correspond to the regions P.

Thus, as described above, the small depressions 13*f* are provided in the regions N, the small depressions 13*g* are provided in the regions O, and the small depressions 13*h* are provided in the regions P. The small depressions 13*f* have the smallest width before crimping, but extend in the circumferential direction by tensile deformation in the circumferential direction during crimping. Further, the small depressions 13*g* have the largest width before crimping, but contract in the circumferential direction by compressive deformation in the circumferential direction during crimping. Furthermore, the small depressions 13*h* do not fluctuate significantly in width before or after crimping.

As a result, after crimping, the widths of the small depressions 13*f*, 13*g*, 13*h* become close to each other, and the small depressions 13*f*, 13*g*, 13*h* substantially have the same shape. It should be noted that the small depressions 13*f*, 13*g*, 13*h* each have a size that readily allows a portion of the conductor wire 25 to enter the small depressions 13*f*, 13*g*, 13*h* during crimping. For example, when the small depressions 13*f*, 13*g*, 13*h* are too small, the conductor wire 25 is not readily pressed into the small depressions 13*f*, 13*g*, 13*h*. On the other hand, when the small depressions 13*f*, 13*g*, 13*h* are too large, the effect of dividing the depression into a plurality of small depressions decreases.

In the present embodiment, the size of each of the small depressions before crimping is optimized so as become a size, after crimping, that facilitates the pressing of the conductor wire 25 and is suited for destroying the surface oxide film and maintaining the crimping force. Accordingly, it is possible to maintain the small depressions in appropriate sizes in any position in the circumferential direction of the conductor wire crimping portion 7 after crimping. It should be noted that, in the present invention, for example, the shape of each of the small depressions 13*h* is set to about 0.4 mm (width)×0.2 mm (length), and the width of each of the small depressions 13*f*, 13*g* may be increased or decreased using this shape as reference.

It should be noted that naturally the working examples described above may be combined. For example, in the terminal 1*c*, each of the small depressions may be formed into a parallelogram shape. Further, the shape of each of the small depressions need not be only rectangular, and may be another shape such as a circular (elliptical). Further, while the working examples describe cases in which aluminum is used for the electric wire, the material is not limited thereto, allowing use of copper for the electric wire as well.

Next, another embodiment will be described. The following embodiment is related to a rectangular wire used in, for example, a stator of a motor generator or the like. A rectangular wire is, for example, disclosed in Japanese Unexamined Patent Application Publication No. 2009-112186A. An object of the embodiment below is to provide a crimping terminal capable of achieving both a favorable electrical connection and waterproofness, thereby realizing excellent intimate contact even when the rectangular wire and the crimping terminal of the stator are made of different metals; a conductor wire with the crimping terminal; and a manufacturing method of the conductor wire with the crimping terminal.

Figure 16A:
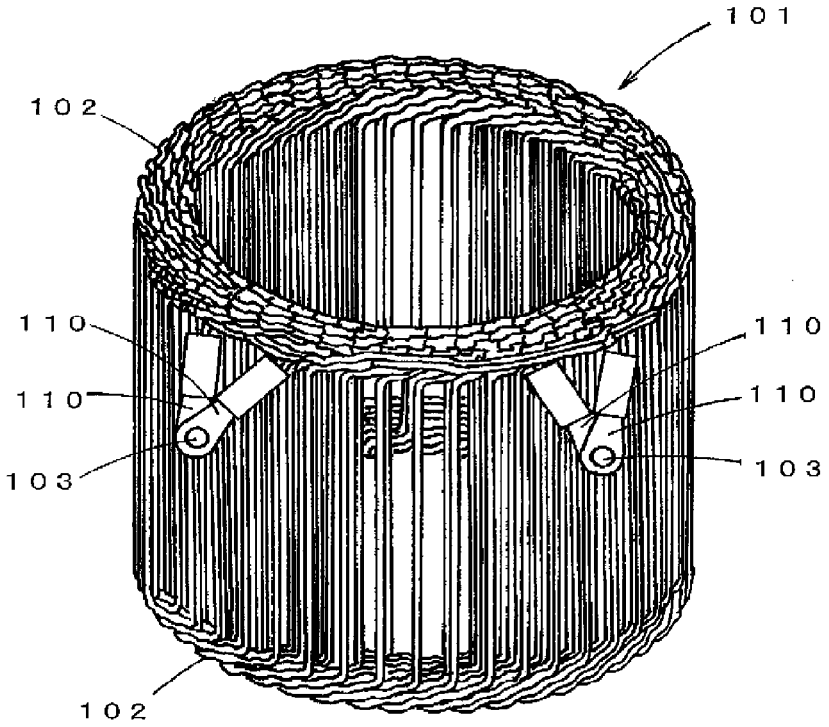
FIG. 16A is a perspective view of a configuration of a stator having applied thereto a motor generator crimping terminal according to an embodiment of the present invention.
Figure 16B:
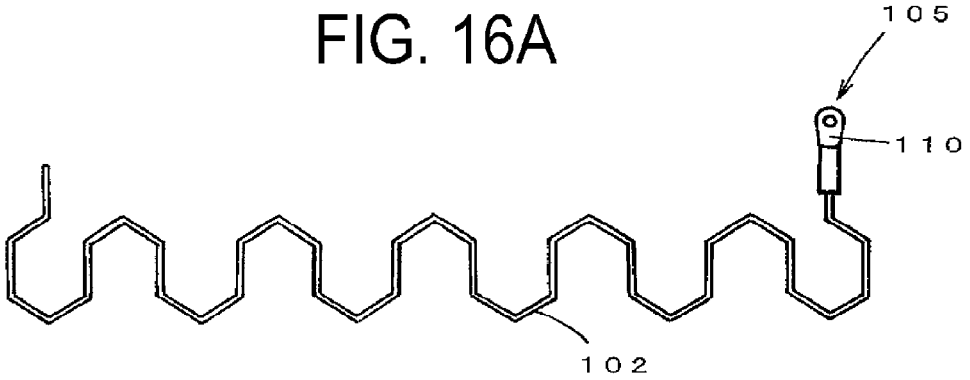
FIG. 16B is a schematic diagram of a configuration of a conductor wire with the motor generator crimping terminal that is used in the stator in FIG. 16A.

FIG. 16A is a perspective view illustrating a configuration of a coil of a stator having applied thereto a motor generator crimping terminal according to the embodiment of the present invention, and FIG. 16B is a diagram schematically illustrating a configuration of a conductor wire with the motor generator crimping terminal to be wound around the stator in FIG. 16A.

As illustrated in FIGS. 16A and 16B, the stator of the motor generator includes a three-phase coil 101 formed using a plurality of windings of each phase, and a stator core (not illustrated). The windings of this coil 101 include a plurality of conductor wires 102, and a motor generator crimping terminal 110 (hereinafter simply referred to as "crimping terminal") is attached to an end portion of each of the conductor wires 102. The crimping terminals 110 are each electrically connected with another crimping terminal or an external circuit via an engaging member 103, such as a bolt.

A conductor wire 105 with a motor generator crimping terminal, as illustrated in FIG. 16B, includes the conductor wire 102 having a continuous pattern shape, and the crimping terminal 110 crimped to the end portion of the conductor wire. The pattern shape of the conductor wire 102 is formed in advance by a bending process for incorporation into the coil 101.

Figure 17:
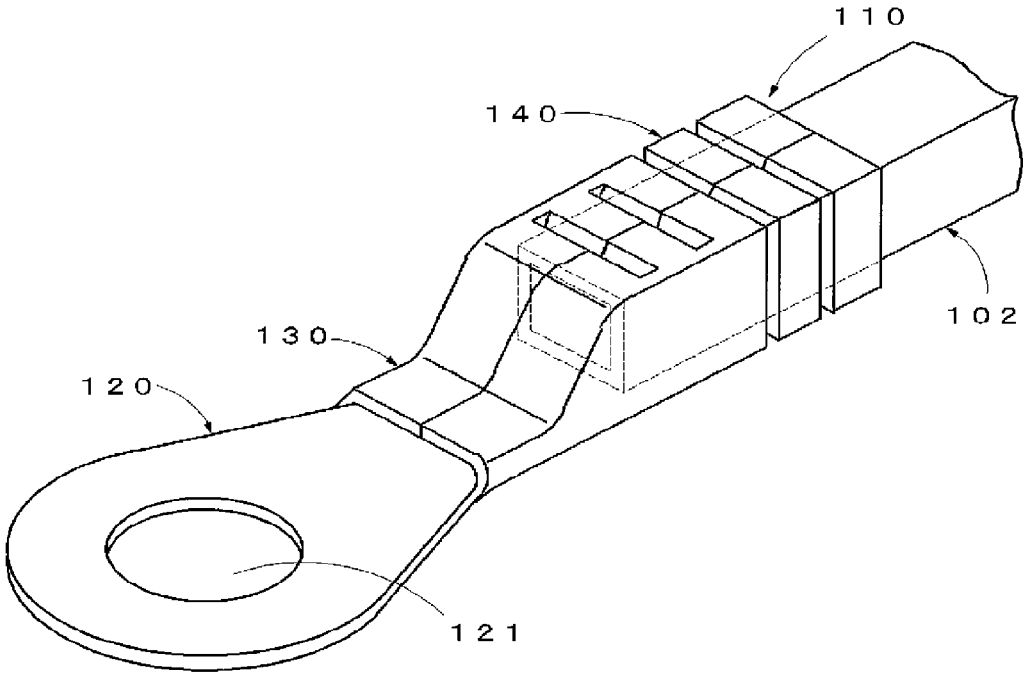
FIG. 17 is a perspective view of the motor generator crimping terminal according to the present embodiment, with the crimping terminal being crimped to the conductor wire.

FIG. 17 is a perspective view of the crimping terminal 110 being crimped to the conductor wire 102. It should be noted that the crimping terminal in FIG. 17 indicates an example, and the configuration of the crimping terminal according to the present invention is not limited to that in FIGS. 16A and 16B.

As illustrated in FIG. 17, the crimping terminal 110 includes a connector portion 120 to be electrically connected with an external terminal, and a cylindrical crimping portion 140 that is integrally provided with the connector portion 120 via a transition portion 130 and that is to be crimped with the conductor wire 102 (rectangular wire) having a substantially rectangular cross section. The crimping terminal 110 is, for example, formed in one piece using copper or a copper alloy, and is attached to the conductor wire 102 having a conductor (core wire) made of aluminum or an aluminum alloy. While the connector portion 120 and the cylindrical crimping portion 140 are integrally formed in the present embodiment, the crimping terminal may be fabricated by forming the connector portion and the cylindrical crimping portion separately and then joining or welding these together.

The connector portion 120 is a round terminal (LA terminal) in which a hole 121 is formed. A bolt or the like is inserted into the hole 121 and connected to another terminal or an external circuit, thereby causing the connector portion 120 to conduct electricity with the outside. The connector portion 120 is a round terminal, but may be a terminal in another shape as long as the connector portion 120 is locked or fitted and electrically connected with another terminal or an external circuit.

Figure 18A:
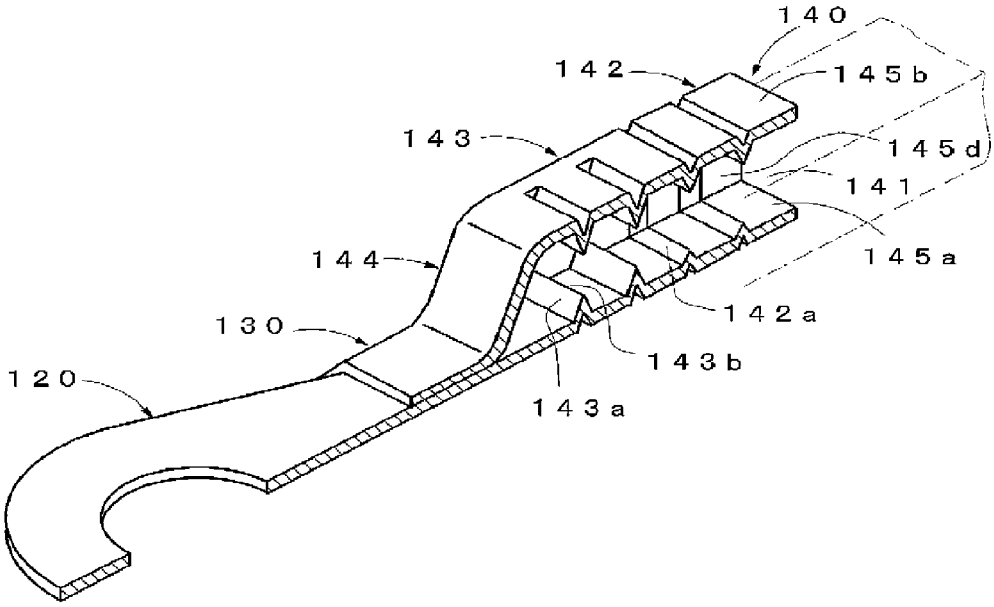
FIGS. 18A and 18B are diagrams of a configuration of a cylindrical crimping portion in FIG. 17, FIG. 18A being a perspective view and FIG. 18B being a partial cross-sectional view.

The cylindrical crimping portion 140, as illustrated in FIG. 18A, is a cylindrical body having a substantially rectangular cross section and closed on the transition portion 130 side, and includes an insertion hole 141 into which the conductor wire 102 is inserted, a cover crimping portion 142 that is crimped with the covering portion of the conductor wire 102, a conductor crimping portion 143 that is disposed on the transition portion 130 side of the cover crimping portion and crimped with the conductor of the conductor wire 102, and a diameter reducing portion 144 that reduces a diameter from the insertion hole 141 side toward the transition portion 130 side. That is, in the present embodiment, the cylindrical crimping portion 140 having a substantially rectangular cross section is crimped at the end portion of the conductor wire 102 having a substantially rectangular cross section.

In this cylindrical crimping portion 140, the cylindrical crimping portion 140 is caulked with the end portion of the conductor wire 102 inserted into the insertion hole 141, thereby causing the cylindrical crimping portion 140 to be subjected to plastic deformation and crimped with the covering portion and the conductor of the conductor wire 102. As a result, the cylindrical crimping portion 140 and the conductor of the conductor wire 102 are electrically connected.

Figure 18B:
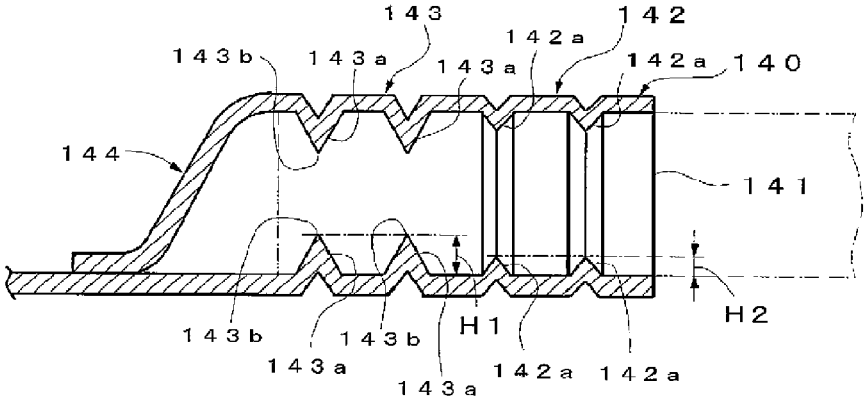

Specifically, the conductor crimping portion 143 includes protruding portions 143*a* (first protruding portions) that protrude toward the inner side of the cylindrical crimping portion 140 and are electrically connected with the conductor of the conductor wire 102 (FIG. 18B). Further, the cover crimping portion 142 includes protruding portions 142*a* (second protruding portions) that protrude toward the inner side of the cylindrical crimping portion 140 and are fitted into the covering portion of the conductor wire 102. The protruding portions 143*a* each have a height H1 that is designed to be greater than a height H2 of each of the protruding portions 142*a*, and a tapered shape that includes a vertex angle portion 143*b* so as to allow the protruding portion 143*a* to pierce the covering portion of the conductor wire 102 and reach the conductor.

The protruding portions 143*a*, 143*a* are respectively formed on surfaces 145*a*, 145*b* (a pair of opposing surfaces) of the cylindrical crimping portion 140, and each protruding portion forms a ridge (first ridge) substantially orthogonal to the longitudinal direction of the cylindrical crimping portion 140. Further, the protruding portions 142*a*, 142*a*, 142*a*, 142*a* are respectively formed on four surfaces 145*a* to 145*d* of the cylindrical crimping portion 140, and each protruding portion forms a ridge (second ridge) substantially orthogonal to the longitudinal direction of the cylindrical crimping portion 140.

The protruding portions 143*a* pierce the covering portion of the conductor wire 102 and conduct electricity with the conductor, and the protruding portions 142*a* are fitted into the covering portion of the conductor wire without piercing the covering portion. It should be noted that while two ridges are formed on one surface of the cylindrical crimping portion 140 in the present embodiment, the number of ridges may be one or three or more. Further, the protruding portions 143*a* need not be ridge shaped, and may have any other shape as long as the shape is capable of maintaining conduction. Further, the protruding portions 142*a* may also have any other shape as long as the shape is capable of maintaining waterproofness.

Next, a manufacturing method of the crimping terminal and the conductor wire with the crimping terminal will be described using FIGS. 19A to 19E.

First, a plate material composed of a metal such as a copper alloy, an aluminum alloy, or a steel is rolled to fabricate a metal strip of a predetermined thickness. Then, the metal strip is subjected to a punching process to form a base material 161 that is a flat, unfolded crimping terminal (refer to FIG. 19A). At this time, the connector portion 120 and the transition portion 130 are formed.

Figure 19A:
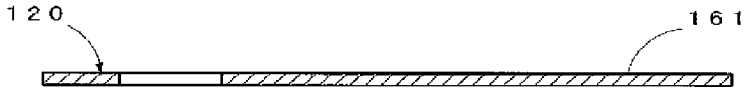
FIGS. 19A to 19E are diagrams for explaining a manufacturing method of the conductor wire with the motor generator crimping terminal in FIG. 16A.
Figure 19B:
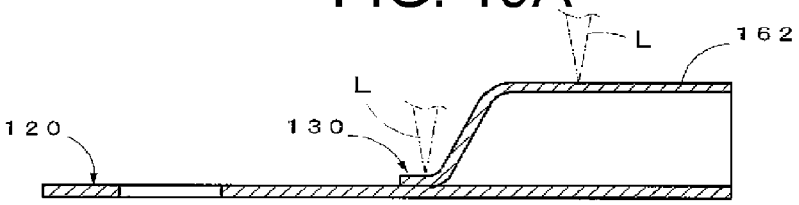

Next, the base material 161 is subjected to a bending process to form a crimping portion cylindrical body 162 having a substantially rectangular cross section (refer to FIG. 19B). At this time, on the upper portion of the crimping portion cylindrical body 162, an abutting portion 170 is formed in the longitudinal direction of the crimping portion cylindrical body, at a substantial center of one surface of the cylindrical body (refer to FIGS. 19C and 20). Then, a fiber laser beam L is irradiated from above the crimping portion cylindrical body 162 and swept along the abutting portion 170, and then the abutting portion 170 is subjected to laser welding. In the above-described punching process, punching is performed so that the abutting portion 170 is formed in the substantial center in the width direction of the crimping portion cylindrical body 162. In the above-described bending process, horizontally uniform pressure is applied to the base material 161, thereby causing the surfaces of the abutting portion 170 to come into contact with each other, thereby improving weldability. Further, the abutting portion 170 is formed in the substantial center in the width direction of the crimping portion cylindrical body 162, thereby allowing the laser process to be more easily performed.

Furthermore, to close the end portion on the transition portion 130 side of the crimping portion cylindrical body 162, laser welding is performed across the entire width of the cylindrical body, substantially orthogonal to the abutting portion 170. As a result, a cylindrical crimping portion having a substantially rectangular cross section is formed, and a motor generator crimping terminal is manufactured.

Figure 19C:
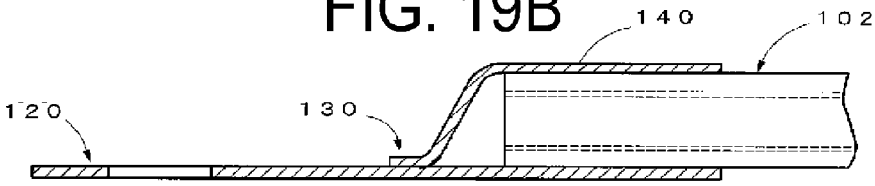
Figure 20:
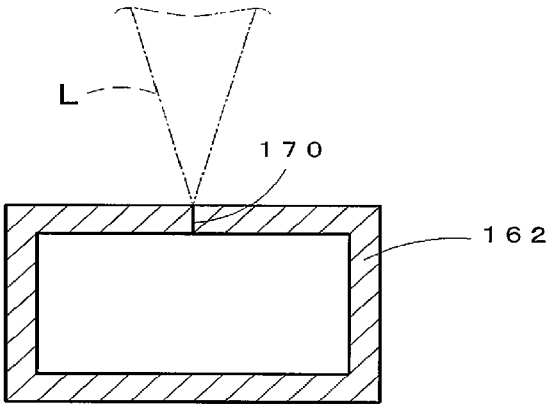
FIG. 20 is a diagram for explaining the details of a laser welding step illustrated in FIG. 19B.
Figure 23A:
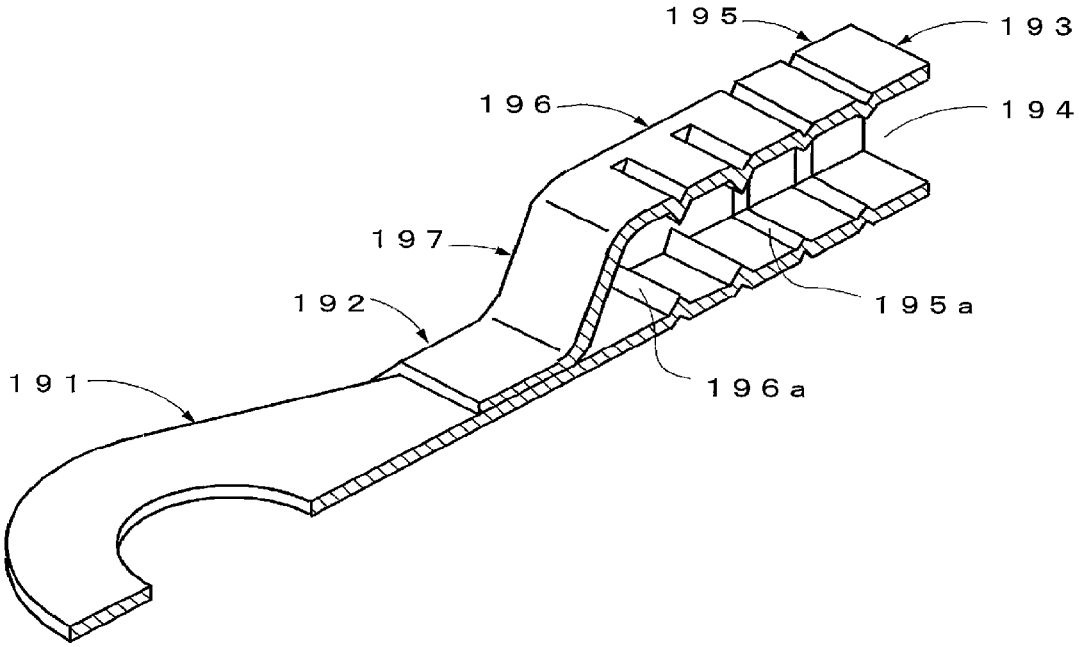
FIGS. 23A and 23B are diagrams illustrating a modified example of the motor generator crimping terminal according to the present embodiment, FIG. 23A being a perspective view and FIG. 23B being a partial cross-sectional view.
Figure 23B:
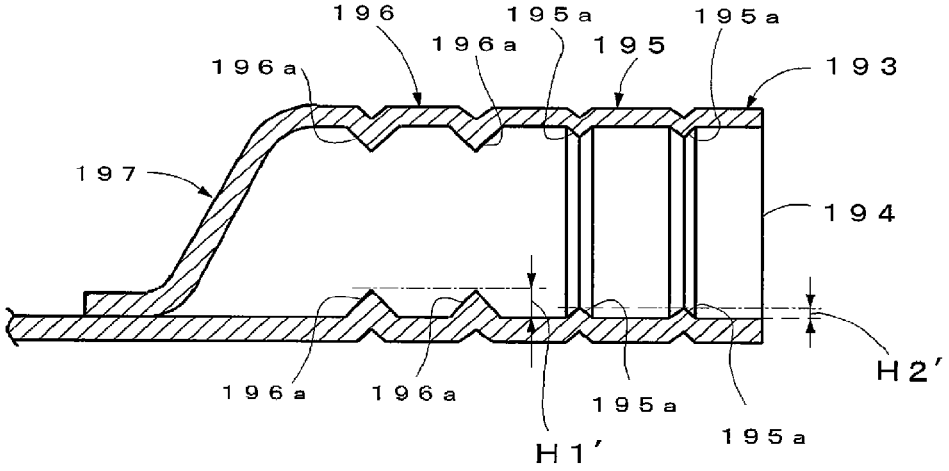

Next, the conductor wire 102 having a substantially rectangular cross section is inserted into the cylindrical crimping portion 140 (FIG. 19C). At this time, the conductor wire is inserted without gaps into the cylindrical crimping portion 140, making it possible to achieve excellent waterproofness. In particular, compared to a case where protruding portions are formed on the cylindrical crimping portion in advance as illustrated in FIGS. 23A and 23B, waterproofness is improved. Further, in the present embodiment, protruding portions are not formed inside the cylindrical crimping portion 140 before the insertion of a conductor wire, making it possible to easily perform the insertion work. Further, the conductor wire 102 can be securely inserted up to a desired position of the cylindrical crimping portion 140.

Figure 19D:
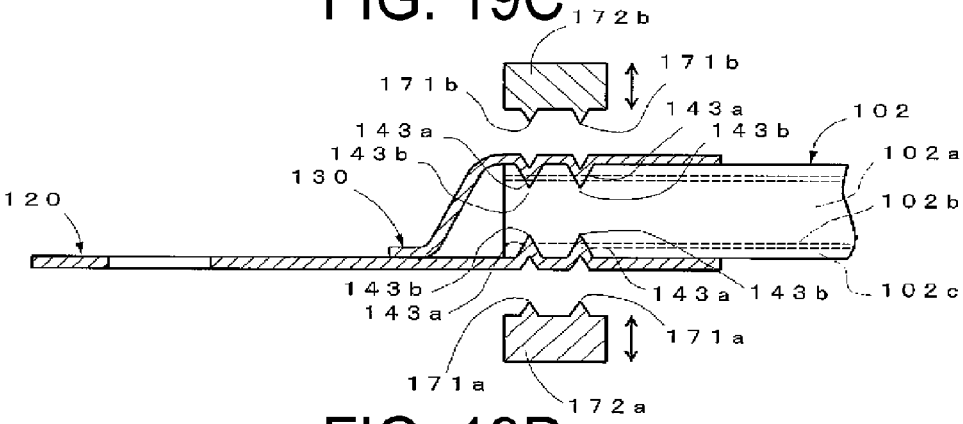
Figure 21A:
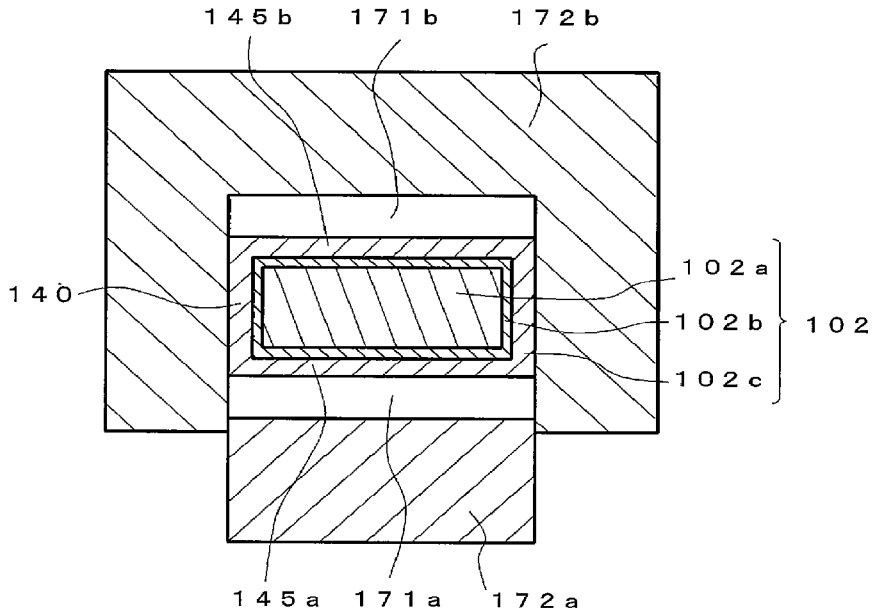

Subsequently, the cylindrical crimping portion 140 is compressed at a predetermined position on the transition portion 130 side to form the protruding portions 143*a* that protrude toward the inner side of the cylindrical crimping portion 140, and electrically connect the conductor 102*a* of the conductor wire 102 with the protruding portions (FIG. 19D). At this time, the surfaces 145*a*, 145*b* of the cylindrical crimping portion 140 are compressed by press surfaces 172*a*, 172*b* that respectively include therein tapered protrusions 171*a*, 171*b* (FIG. 21A). As a result, the protruding portions 143*a* are formed on the upper and lower surfaces of the cylindrical crimping portion 140. Further, each of the conductor wires 102, as described later, includes a conductor 102*a*, an inside layer 102*b*, and an outside layer 102*c*, and tapered vertex angle portions 143*b* are formed simultaneously with the protruding portions 143*a*, thereby causing the protruding portions 143*a* to pierce the inside layer 102*b* and the outside layer 102*c* and reach the conductor 102*a*, and electrically connecting the cylindrical crimping portion 140 and the conductor 102*a*. It should be noted that, when this compressing process is performed, the conductor 102*a* extends slightly toward the transition portion 130 side, and therefore the conductor wire 102 is positioned taking into consideration the amount of extension of the conductor 102*a*.

Figure 19E:
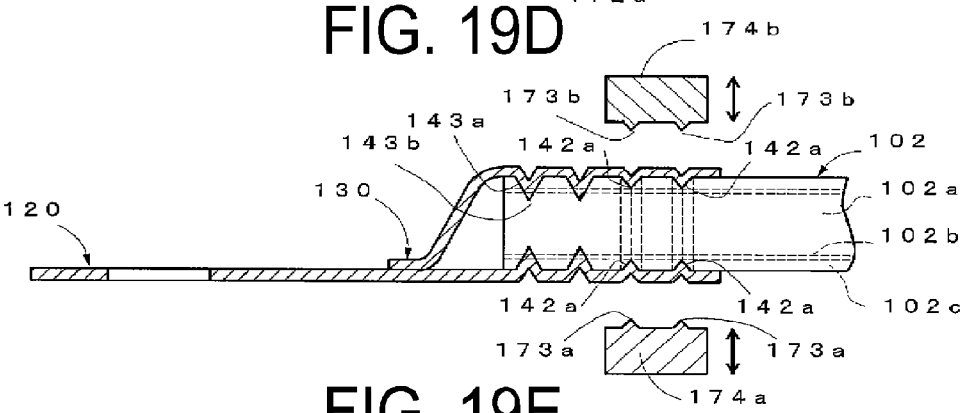
Figure 21B:
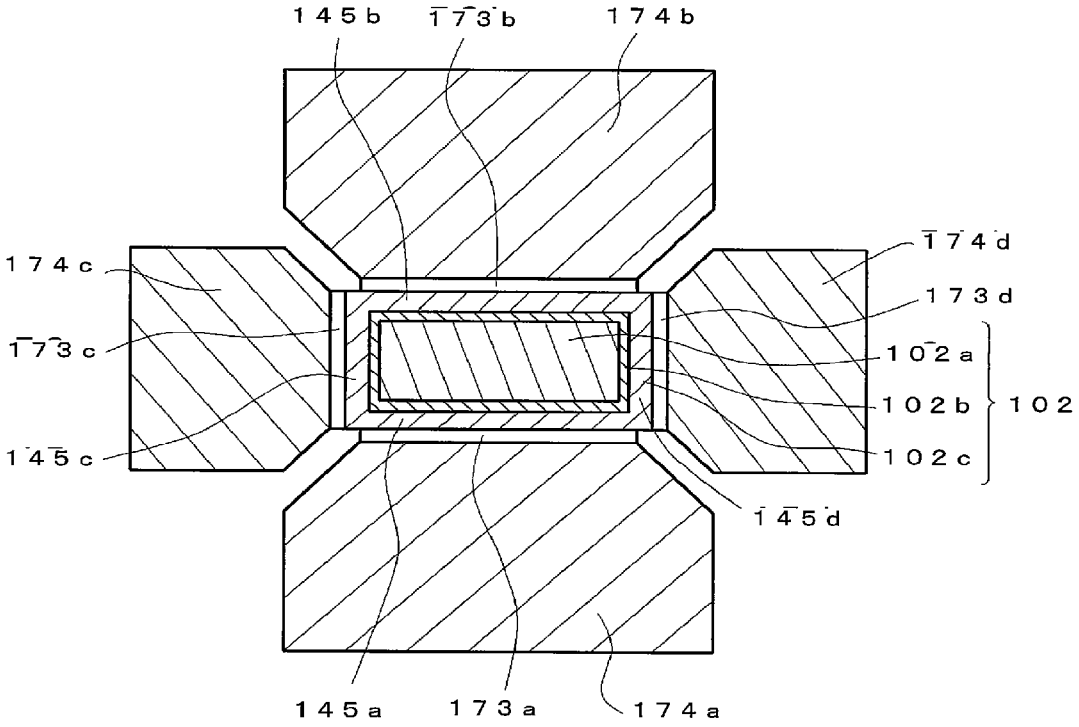

Next, the cylindrical crimping portion 140 is compressed at a predetermined position on the insertion hole 141 side to form the protruding portions 142*a* that protrude toward the inner side of the cylindrical crimping portion 140, and fit the outside layer 102*c* of the conductor wire 102 with the protruding portions (FIG. 19E). At this time, the surfaces 145*a* to 145*d* (four surfaces) of the cylindrical crimping portion 140 are compressed by press surfaces 174*a* to 174*d* that respectively include therein protrusions 173*a* to 173*d* (FIG. 21B). As a result, the protruding portions 143*a* are formed on upper, lower, left, and right surfaces of the cylindrical crimping portion 140. Further, at this time, the protrusion 173*a* of the press surface 174*a* has a height that is less than that of the protrusion 171*a* and determined taking into consideration thicknesses of the inside layer 102*b* and the outside layer 102*c*, and thus the protruding portions 143*a* do not reach the conductor 102*a*. As a result of this compressing process, the entire periphery of the cylindrical crimping portion 140 is fitted to the inside layer 102*b* by the protruding portions 142*a*, the internal space and exterior of the cylindrical crimping portion 140 are blocked off with the protruding portions 142*a* serving as boundaries, and waterproofness is maintained.

It should be noted that while the step (FIG. 19E) of fitting the protruding portions 142*a* and the outside layer 102*c* of the conductor wire 102 is executed after the step (FIG. 19D) of electrically connecting the protruding portions 143*a* and the conductor 102*a* of the conductor wire 102 in the above-described manufacturing method, the method is not limited thereto, and the step may be executed at the same time as the step of electrically connecting the protruding portions 143*a* and the conductor 102*a* of the conductor wire 102.

Figure 22A:
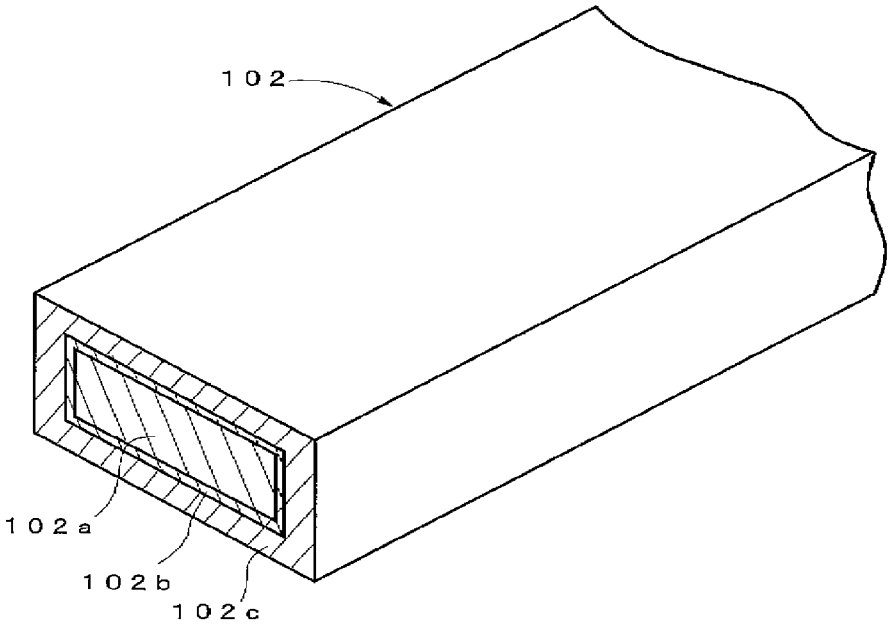
FIGS. 22A and 22B are diagrams of a rectangular wire attached to the motor generator crimping terminal in FIG. 17.

FIG. 22A is a diagram illustrating the conductor wire 102 attached to the crimping terminal 110 in FIG. 17.

As illustrated in FIG. 22A, the conductor wire 102 includes the conductor 102*a* having a substantially rectangular cross section, the inside layer 102*b* that covers the conductor 102*a*, and the outside layer 102*c* that covers the inside layer 102*b*. From the viewpoints of heat resistance and insulation properties, the inside layer 102*b* is, for example, composed of polyimide or polyamide-imide, and is formed by applying an enamel coating to the conductor 102*a*. The outside layer 102*c* is composed of an insulating material such as nylon. When the inside layer 102*b* is made of enamel, the inside layer 102*b* may become a hard covering layer, depending on the thickness. In the present embodiment, however, the protruding portions 143 have the vertex angle portions 143*b*, and therefore the vertex angle portions can reliably pierce the inside layer 102*b*, ensuring conduction between the cylindrical crimping portion 140 and the conductor 102*a*.

Figure 22B:
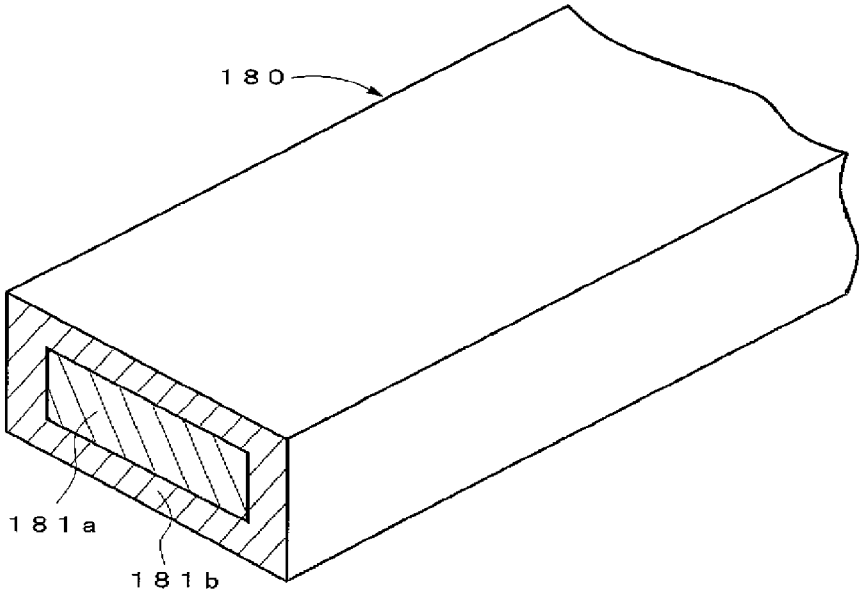

It should be noted that while the conductor wire 102 has a covering portion composed of the inside layer 102*b* and the outside layer 102*c* in the present embodiment, a conductor wire having a covering portion of one layer as illustrated in FIG. 22B may be used. For example, a conductor wire 180 may include the conductor 181 composed of copper or a copper alloy, and a covering layer 182 composed of polyimide or polyamide-imide.

As described above, according to the present embodiment, the cylindrical crimping portion 140 is a cylindrical body having a substantially rectangular cross section into which the conductor wire 102 is inserted. The cylindrical body includes the protruding portions 143*a* electrically connected with the conductor 102*a* of the conductor wire 102, and the protruding portions 142*a* fitted into the outside layer 102*c* of the conductor wire 102. That is, the protruding portions 143*a* protrude to the conductor 102*a*, thereby causing conduction with the conductor 102*a*. Furthermore, the protruding portions 142*a* protrude to the outside layer 102*c* without coming into contact with the conductor 102*a*, thereby blocking off the cylindrical body interior and exterior. Thus, even if the conductor wire 102, which is a rectangular wire, and the crimping terminal 110 are formed of different metals, a favorable electrical connection and waterproofness are both achieved, making it possible to achieve excellent intimate contact.

Further, according to the above-described manufacturing method, a portion of the cylindrical crimping portion 140 is compressed to form the protruding portions 143*a* and electrically connect the protruding portions 143*a* and the conductor 102*a* of the conductor wire 102. Furthermore, another portion of the cylindrical crimping portion 140 is compressed to form the protruding portions 142*a* and fit the outside layer 102*c* of the conductor wire 102 with the protruding portions 142*a*. As a result, a favorable electrical connection and waterproofness are both achieved, making it possible to achieve excellent intimate contact. Further, the conductor wire 102 is inserted into the cylindrical crimping portion 140 and the crimping process is performed without requiring a terminal process of peeling off the covering portion of the end portion of the conductor wire 102, making it possible to achieve the above-described effect and simplify the manufacturing steps.

While the above has described the method of manufacturing the crimping terminal according to the embodiment, the present invention is not limited to the embodiment, and various modifications and changes may be made on the basis of the technical idea of the present invention.

For example, while the protruding portions 142*a*, 143*a* are formed on the cylindrical crimping portion 140 during conductor wire crimping in the embodiment, the present invention is not limited thereto, and the protruding portions may be formed on the cylindrical crimping portion before conductor wire crimping. For example, as illustrated in FIG. 23A, a crimping terminal 190 includes a connector portion 191 electrically connected with an external terminal, and a cylindrical crimping portion 193 integrally provided with the connector portion via a transition portion 192 and crimped with the rectangular wire. Then, the cylindrical crimping portion 193 includes an insertion hole 194 into which the conductor wire is inserted, a cover crimping portion 195 crimped with the covering portion of the conductor wire, a conductor crimping portion 196 that is disposed on the transition portion 192 side of the cover crimping portion and crimped with the conductor of the conductor wire, and a diameter reducing portion 197 that reduces a diameter from the insertion hole 194 side toward the transition portion 192 side. The conductor crimping portion 196 includes protruding portions 196*a* that protrude toward the inner side of the cylindrical crimping portion 193 and are electrically connected with the conductor of the conductor wire (FIG. 23B). Further, the cover crimping portion 195 includes protruding portions 195*a* that protrude toward the inner side of the cylindrical crimping portion 193 and are fitted into the covering portion of the conductor wire. A height H1' of each of the protruding portions 196*a* is greater than a height H2' of each of the protruding portions 195*a*. Further, the height H1' of each of the protruding portions 196*a* is less than the height H1 of each of the protruding portions 143*a* (H1'<H1), and the height H2' of each of the protruding portions 195*a* is less than the height H2 of each of the protruding portions 142*a* (H2'<H2). These protruding portions 195*a*, 196*a* are inwardly compressed during crimping, thereby resulting in further protrusion toward the inner side and their heights being respectively the same as those of the protruding portion 142*a*, 143*a* illustrated in FIG. 18B.

Thus, the protruding portions 195*a*, 196*a* are formed in advance on the cylindrical crimping portion 193 before conductor wire crimping, thereby making it possible to suppress a reduction in the plate thickness of the protruding portions 195*a*, 196*a* or nearby areas during crimping, and further increase a mechanical strength of the cylindrical crimping portion 193.

Further, while the abutting portion is formed on the crimping cylindrical body before the welding step in the above-described embodiment, only an overlapping portion may be formed, or both the abutting portion and the overlapping portion may be formed.

Further, while fiber laser welding is performed in the welding step, the present invention is not limited thereto, and another welding method capable of welding the abutting portion or the overlapping portion may be adopted.

Further, while the conductor wire 105 with the motor generator crimping terminal includes the conductor wire 102 and the crimping terminal 110 in the above-described embodiment, the conductor wire 105 may further include a sealing portion formed by applying resin or the like so as to cover the end portion of the cylindrical crimping portion 140 on the insertion hole 141 side to achieve more reliable waterproofness.

Thus, the crimping terminal according to the present embodiment is a crimping terminal that includes a connector portion electrically connected with an external terminal, and a cylindrical crimping portion coupled with the connector portion and crimped with a conductor wire having a substantially rectangular cross section. The cylindrical crimping portion is a cylindrical body having a substantially rectangular cross section into which the conductor wire is inserted, and the cylindrical body includes first protruding portions that protrude toward the inner side of the cylindrical body and are electrically connected with the conductor of the conductor wire, and second protruding portions that protrude toward the inner side of the cylindrical body and are fitted into the covering portion of the conductor wire.

A height of each of the first protruding portions is greater than a height of each of the second protruding portions.

The second protruding portions are formed on four surfaces of the cylindrical body, and serve as second ridges formed substantially orthogonal to the longitudinal direction of the cylindrical body.

Further, to achieve the object of the present embodiment, a conductor wire with a crimping terminal according to the present embodiment is a conductor wire with a crimping terminal having a substantially rectangular cross section, the crimping terminal being crimped at the end portion thereof. The crimping terminal includes a connector portion to be electrically connected with an external terminal, and a cylindrical crimping portion to be coupled with the connector portion and to be crimped with the conductor wire. The cylindrical crimping portion is a cylindrical body having a substantially rectangular cross section into which the conductor wire is inserted, and the cylindrical body includes first protruding portions that protrude toward the inner side of the cylindrical body and are electrically connected with the conductor of the conductor wire, and second protruding portions that protrude toward the inner side of the cylindrical body and are fitted into the covering portion of the conductor wire.

Further, a height of each of the first protruding portions is greater than a height of each of the second protruding portions.

Furthermore, the second protruding portions are formed on four surfaces of the cylindrical body, and serve as second ridges formed substantially orthogonal to the longitudinal direction of the cylindrical body.

The conductor wire may have a pattern shape formed by a bending process.

Further, the crimping terminal is preferably composed of copper or a copper alloy, and the conductor is preferably composed of aluminum or an aluminum alloy.

Further, to achieve the object of the present embodiment, a manufacturing method of a conductor wire with a crimping terminal according to the present embodiment is a manufacturing method of a conductor wire with a crimping terminal including a connector portion electrically connected with an external terminal, a crimping terminal that includes a cylindrical crimping portion coupled with the connector portion and crimped with a conductor wire, and a conductor wire having a substantially rectangular cross section. The manufacturing method includes the steps of bending a plate material to form a cylindrical body having a substantially rectangular cross section and including an abutting portion, welding the abutting portion of the cylindrical body to form a cylindrical crimping portion, inserting the conductor wire having a substantially rectangular cross section into the cylindrical crimping portion, compressing a portion of the cylindrical crimping portion to form first protruding portions that protrude toward the inner side and electrically connect the first protruding portions and a conductor of the conductor wire, and compressing another portion of the cylindrical crimping portion to form second protruding portions that protrude toward the inner side and fit the second protruding portions and a covering portion of the conductor wire. The step of fitting the second protruding portions and the covering portion of the conductor wire is executed at the same time as or after the step of electrically connecting the first protruding portions and the conductor of the conductor wire.

According to the crimping terminal and the conductor wire with the crimping terminal of the present embodiment, the cylindrical crimping portion is a cylindrical body having a substantially rectangular cross section into which the conductor wire is inserted, and the cylindrical body includes the first protruding portions electrically connected with the conductor of the conductor wire, and the second protruding portions fitted into the covering portion of the conductor wire. That is, the first protruding portions protrude to the conductor, thereby causing conduction with the conductor. Furthermore, the second protruding portions protrude to the covering portion without coming into contact with the conductor, thereby blocking off the cylindrical body interior and exterior. Thus, even if the stator rectangular wire and the crimping terminal are formed of different metals, a favorable electrical connection and waterproofness are both achieved, making it possible to achieve excellent intimate contact.

Further, according to the manufacturing method of the present invention, a portion of the cylindrical crimping portion is compressed to form the first protruding portions that inwardly protrude and electrically connect the first protruding portions with the conductor of the conductor wire. Furthermore, another portion of the cylindrical crimping portion is compressed to form the second protruding portions that inwardly protrude and fit the covering portion of the conductor wire with the second protruding portions. As a result, a favorable electrical connection and waterproofness are both achieved, making it possible to achieve excellent intimate contact. Further, the conductor wire is inserted into the cylindrical crimping portion and the crimping process is performed without requiring a terminal process of peeling off the covering portion of the end portion of the conductor wire end portion, making it possible to achieve the above-described effect and simplify the manufacturing steps.

The crimping terminal and the conductor wire with the crimping terminal of the present embodiment can be, for example, applied to a motor generator, or used for an electric wire, automobile harness, or the like designed for the purpose of space saving.

While the above has described embodiments of the present invention while referring to accompanying drawings, the technical scope of the present invention is not influenced by the aforementioned embodiments. It will be apparent to those skilled in the art that various modifications and variations can be made to the present invention within the scope of the technical ideas described in the appended claims. Thus, it is intended that these modifications and variations are within the technical scope of the present invention. Further, a plurality of wire harnesses according to the present invention may be tied in a bundle and used. In the present invention, a structure that thus includes the plurality of wire harnesses tied in a bundle is referred to as a wire harness structure.

REFERENCE SIGNS LIST

1, 1*a*, 1*b*, 1*c* Terminal
3 Terminal main body
5 Crimping portion
7 Conductor wire crimping portion
9 Cover crimping portion
13*a*, 13*b*, 13*c* Depression
13*d*, 13*e*, 13*f*, 13*g*, 13*h* Small depression
14 Upper side
15 Elastic contact piece
17 Front end portion
19 Rear end portion
21 Joining portion
22 Sealing portion
23 Covered conductor wire
25 Conductor wire
27 Covering portion
30*a* Upper die
30*b* Lower die
32 Die angled portion
101 Coil
102 Conductor wire
102*a* Conductor
102*b* Inside layer
102*c* Outside layer
103 Engaging member
105 Conductor wire with motor generator crimping terminal
110 Crimping terminal
120 Connector portion
121 Hole
130 Transition portion
140 Cylindrical crimping portion
141 Insertion hole
142 Cover crimping portion
142*a* Protruding portion
143 Conductor crimping portion
143*a* Protruding portion
143*b* Vertex angle portion
144 Diameter reducing portion
145*a*, 145*b*, 145*c*, 145*d* Surface
161 Base material
162 Crimping portion cylindrical body
170 Abutting portion
171*a*, 171*b* Protrusion
172*a*, 172*b* Press surface
173*a*, 173*b*, 173*c*, 173*d* Protrusion
174*a*, 174*b*, 174*c*, 174*d* Press surface
180 Conductor wire
181 Conductor
182 Covering layer
190 Crimping terminal
191 Connector portion
192 Transition portion
193 Cylindrical crimping portion
194 Insertion hole
195 Cover crimping portion
195*a* Protruding portion
196 Conductor crimping portion
196*a* Protruding portion
197 Diameter reducing portion

The invention claimed is:

1. A terminal connected to a covered conductor wire, the terminal comprising:

a terminal main body; and a cylindrical crimping portion;

the crimping portion including:

a cover crimping portion that crimps a covering portion, and a conductor wire crimping portion that crimps a conductor wire exposed from the covering portion, wherein the edge portions of the crimping portion are joined at a joining portion on an upper side of the crimping portion, a sealing portion is provided on a front end portion of the crimping portion, the crimping portion being sealed in all areas excluding an area through which the covered conductor wire is inserted to prevent penetration of moisture into the crimping portion;

the conductor wire crimping portion includes a plurality of depressions on an inner surface thereof, the depressions being formed in a plurality of rows in an axial direction of the conductor wire crimping portion and including main depressions formed at a substantial center in the axial direction of the conductor wire crimping portion and sub-depressions formed on both sides of the main depressions, the main depressions being formed substantially across an entire periphery of the wire crimping portion, at least one of the sub-depressions is formed in a region of the front portion of the wire crimping portion where the height of the crimping portion decreases toward the sealing portion, the sub-depressions having a formation range shorter than that of the main depressions and not being formed on an the upper side of the wire crimping portion, the depressions are formed by a plurality of small depressions that are provided in a circumferential direction of the conductor wire crimping portion, and the small depressions include first small depressions provided on substantially upper and lower portions corresponding to a crimping direction, second small depressions provided on both side portions substantially orthogonal to the crimping direction of the conductor wire crimping portion, and third small depressions provided between the first small depressions and the second small depressions, in the circumferential direction of the conductor wire crimping portion, a length in the circumferential direction of the first small depressions being less than a length in the circumferential direction of the third small depressions, and a length in the circumferential direction of the second small depressions being greater than the length in the circumferential direction of the third small depressions.

2. A wire harness including a covered conductor wire and a terminal that are connected with each other, wherein the terminal includes a terminal main body and a cylindrical crimping portion;

the crimping portion includes a cover crimping portion that crimps a covering portion and a conductor wire crimping portion that crimps a conductor wire exposed from the covering portion, the crimping portion being sealed in all areas excluding an area through which the covered conductor wire is inserted;

the conductor wire crimping portion includes a plurality of depressions on an inner surface thereof, the depressions being formed in a plurality of rows in an axial direction of the conductor wire crimping portion and including main depressions formed at a substantial center in the axial direction of the conductor wire crimping portion and sub-depressions formed on both sides of the main depression;

the main depressions are formed substantially across an entire periphery of the wire crimping portion, and the sub-depressions have a formation range shorter than that of the main depressions and not being formed on an upper side of the wire crimping portion; and the conductor wire crimping portion includes a straight portion at a substantial center in the axial direction of the conductor wire crimping portion, the straight portion having high compressibility and tapered portions on both sides of the straight portion in the axial direction of the conductor wire crimping portion, the main depressions being positioned in the straight portion, and the sub-depressions being positioned at a boundary portion between the straight portion and one of the tapered portions.

3. The wire harness according to claim 2, wherein the conductor wire is made of an aluminum-based material.

4. A terminal and covered conductor wire connection method in which the terminal includes a terminal main body and a cylindrical crimping portion; the crimping portion includes a cover crimping portion that crimps a covering portion and a conductor wire crimping portion that crimps a conductor wire exposed from the covering portion, the crimping portion being sealed in all areas excluding an area through which the covered conductor wire is inserted; and the conductor wire crimping portion includes a plurality of depressions on an inner surface thereof, the depressions being formed in a plurality of rows in an axial direction of the conductor wire crimping portion and including main depressions formed at a substantial center in the axial direction of the conductor wire crimping portion and sub-depressions formed on both sides of the main depressions, the main depressions being formed substantially across an entire periphery of the wire crimping portion; and the sub-depressions having a formation range shorter than at of the main depressions and not being formed on an upper side of the wire crimping portion, the method comprising the steps of:

inserting the covered conductor wire into the crimping portion; and crimping the conductor wire crimping portion using a die, wherein the die includes a straight portion in an area corresponding to a substantial center in the axial direction of the conductor wire crimping portion and tapered portions in areas corresponding to both sides of the straight portion in the axial direction of the conductor wire crimping portion, the die compressing an area having the main depressions disposed therein at the straight portion, and areas having the sub-depressions disposed therein at a boundary portion between the straight portion and one of the tapered portions.

5. A wire harness structure comprising:

a plurality of wire harnesses tied in a bundle, each of the wire harnesses including a covered conductor wire and a terminal that are connected with each other;

the terminal including a terminal main body and a cylindrical crimping portion;

the crimping portion including a cover crimping portion that crimps a covering portion and a conductor wire crimping portion that crimps a conductor wire exposed from the covering portion, the edge portions of the crimping portion are joined at a joining portion on an upper side of the crimping portion, a sealing portion is provided on a front end portion of the crimping portion, and the crimping portion being sealed in all areas excluding an area through which the covered conductor wire is inserted to prevent penetration of moisture into the crimping portion;

the conductor wire crimping portion including a plurality of depressions on an inner surface thereof, the depressions being formed in a plurality of rows in an axial direction of the conductor wire crimping portion and including main depressions formed at a substantial center in the axial direction of the conductor wire crimping portion and sub-depressions formed on both sides of the main depressions; and the main depressions being formed substantially across an entire periphery of the wire crimping portion, at least one of the sub-depressions is formed in a region of the front portion of the wire crimping portion where the height of the crimping portion decreases toward the sealing portion, the sub-depressions having a formation range shorter than that of the main depressions and not being formed on the upper side of the wire crimping portion, the depressions being formed by a plurality of small depressions that are provided in a circumferential direction of the conductor wire crimping portion, the small depressions including first small depressions provided on substantially upper and lower portions corresponding to a crimping direction, second small depressions provided on both side portions substantially orthogonal to the crimping direction of the conductor wire crimping portion, and third small depressions provided between the first small depressions and the second small depressions, in the circumferential direction of the conductor wire crimping portion, a length in the circumferential direction of the first small depressions being less than a length in the circumferential direction of the third small depressions, and a length in the circumferential direction of the second small depressions being greater than the length in the circumferential direction of the third small depressions.

* * * * *